US008206009B2

(12) United States Patent
Tickner et al.

(10) Patent No.: US 8,206,009 B2
(45) Date of Patent: Jun. 26, 2012

(54) LIGHT EMITTING DIODE LAMP SOURCE

(75) Inventors: Jerold Alan Tickner, Newnan, GA (US); Scott David Wegner, Peachtree City, GA (US); Evans Edward Thompson, III, Fairburn, GA (US)

(73) Assignee: Cooper Technologies Company, Houston, TX (US)

( * ) Notice: Subject to any disclaimer, the term of this patent is extended or adjusted under 35 U.S.C. 154(b) by 370 days.

(21) Appl. No.: 12/494,944

(22) Filed: Jun. 30, 2009

(65) Prior Publication Data

US 2009/0262530 A1 Oct. 22, 2009

Related U.S. Application Data

(63) Continuation-in-part of application No. 12/183,499, filed on Jul. 31, 2008.

(60) Provisional application No. 61/153,797, filed on Feb. 19, 2009, provisional application No. 61/104,444, filed on Oct. 10, 2008, provisional application No. 60/994,371, filed on Sep. 19, 2007.

(51) Int. Cl.
*F21V 29/00* (2006.01)

(52) U.S. Cl. ..... 362/294; 362/373

(58) Field of Classification Search ..... 362/218, 362/294, 373

See application file for complete search history.

(56) References Cited

U.S. PATENT DOCUMENTS 4,271,408 A 6/1981 Teshima et al.
5,890,794 A * 4/1999 Abtahi et al. ..... 362/294
6,448,900 B1 9/2002 Chen
6,547,417 B2 4/2003 Lee
6,561,690 B2 5/2003 Balestriero et al.
6,682,211 B2 1/2004 English et al.
7,014,337 B2 * 3/2006 Chen ..... 362/240
7,048,412 B2 * 5/2006 Martin et al. ..... 362/247
7,144,135 B2 12/2006 Martin et al.
7,242,028 B2 7/2007 Dry
7,314,291 B2 * 1/2008 Tain et al. ..... 362/294
7,440,280 B2 10/2008 Shuy
7,568,817 B2 8/2009 Lee et al.
7,581,856 B2 * 9/2009 Kang et al. ..... 362/373
7,593,229 B2 9/2009 Shuy
7,641,361 B2 * 1/2010 Wedell et al. ..... 362/240
7,651,253 B2 1/2010 Shuy
7,677,763 B2 * 3/2010 Chan ..... 362/249.02
7,748,876 B2 7/2010 Zhang et al.
7,758,214 B2 * 7/2010 Lee et al. ..... 362/294
2003/0040200 A1 * 2/2003 Cao ..... 438/800
2004/0095777 A1 * 5/2004 Trenchard et al. ..... 362/477
(Continued)

*Primary Examiner* — David Crowe
(74) *Attorney, Agent, or Firm* — King & Spalding LLP

(57) ABSTRACT

A light fixture includes a core member having a top end, a bottom end, and a body extending between the top and bottom ends. The core member includes a solid, single member or modular members. The body includes outer surfaces ("facets") spaced along an outer perimeter thereof. Each facet can receive one or more light emitting diode ("LED") packages in various different positions, with different electrical and other configurations. By rearranging and/or reconfiguring the LED packages, the light fixture can have different optical distributions, such as that traditionally provided by metal halide, high intensity discharge, quartz, sodium, incandescent, and fluorescent light sources. Heat pipes extending through the core member dissipate heat from the LEDs. Active cooling modules and/or fins may assist with this heat dissipation. The heat pipes and/or a separate elongated structure extending through the core member can secure the core member to the light fixture.

21 Claims, 14 Drawing Sheets

U.S. PATENT DOCUMENTS

2005/0174780 A1 8/2005 Park
2007/0159828 A1* 7/2007 Wang ..... 362/294
2008/0002399 A1 1/2008 Villard et al.
2008/0316755 A1 12/2008 Zheng et al.
2009/0021944 A1 1/2009 Lee et al.
2009/0040759 A1 2/2009 Zhang et al.
2009/0073688 A1 3/2009 Patrick et al.
2009/0073689 A1 3/2009 Patrick
2009/0244896 A1 10/2009 McGehee et al.
2009/0262530 A1 10/2009 Tickner
2010/0091495 A1 4/2010 Patrick
2010/0208460 A1 8/2010 Ladewig et al.

* cited by examiner

LIGHT EMITTING DIODE LAMP SOURCE

RELATED APPLICATION

This patent application is a continuation-in-part of U.S. patent application Ser. No. 12/183,499, titled "Light Fixture With an Adjustable Optical Distribution," filed Jul. 31, 2008, which claims priority under 35 U.S.C. §119 to U.S. Provisional Patent Application No. 60/994,371, titled "Flexible Light Emitting Diode Optical Distribution," filed Sep. 19, 2007, and is related to U.S. patent application Ser. No. 12/183,490, titled "Heat Management For A Light Fixture With An Adjustable Optical Distribution," filed Jul. 31, 2008. This patent application also claims priority under 35 U.S.C. §119 to U.S. Provisional Patent Application No. 61/104,444, titled "Light Emitting Diode Post Top Light Fixture," filed Oct. 10, 2008, and U.S. Provisional Patent Application No. 61/153,797, titled "Luminaire with LED Illumination Core," filed Feb. 19, 2009. The complete disclosure of each of the foregoing priority and related applications is hereby fully incorporated herein by reference.

TECHNICAL FIELD

The invention relates generally to light fixtures and more particularly to light fixtures with adjustable optical distributions.

BACKGROUND

A luminaire is a system for producing, controlling, and/or distributing light for illumination. For example, a luminaire includes a system that outputs or distributes light into an environment, thereby allowing certain items in that environment to be visible. Luminaires are used in indoor or outdoor applications.

A typical luminaire includes one or more light emitting elements, one or more sockets, connectors, or surfaces configured to position and connect the light emitting elements to a power supply, an optical device configured to distribute light from the light emitting elements, and mechanical components for supporting or suspending the luminaire. Luminaires are sometimes referred to as "lighting fixtures" or as "light fixtures." A light fixture that has a socket, connector, or surface configured to receive a light emitting element, but no light emitting element installed therein, is still considered a luminaire. That is, a light fixture lacking some provision for full operability may still fit the definition of a luminaire. The term "light emitting element" is used herein to refer to any device configured to emit light, such as a lamp or a light emitting diode ("LED").

Optical devices are configured to direct light energy emitted by light emitting elements into one or more desired areas. For example, optical devices may direct light energy through reflection, diffusion, baffling, refraction, or transmission through a lens. Lamp placement within the light fixture also plays a significant role in determining light distribution. For example, a horizontal lamp orientation typically produces asymmetric light distribution patterns, and a vertical lamp orientation typically produces a symmetric light distribution pattern.

Different lighting applications require different optical distributions. For example, a lighting application in a large, open environment may require a symmetric, square distribution that produces a wide, symmetrical pattern of uniform light. Another lighting application in a smaller or narrower environment may require a non-square distribution that produces a focused pattern of light. For example, the amount and direction of light required from a light fixture used on a street pole depends on the location of the pole and the intended environment to be illuminated.

Conventional light fixtures are configured to only output light in a single, predetermined distribution. To change an optical distribution in a given environment having a conventional fixture, a person must uninstall the existing light fixture and install a new light fixture with a different optical distribution. These steps are cumbersome, time consuming, and expensive.

Therefore, a need exists in the art for an improved means for adjusting optical distribution of a light fixture. In particular, a need exists in the art for efficient, user-friendly, and cost-effective systems and methods for adjusting LED optical distributions of a light fixture.

SUMMARY

The invention provides an improved means for adjusting optical distribution of a light fixture. In particular, the invention provides an LED light fixture with an adjustable optical distribution. The light fixture can be used in both indoor and outdoor applications. By adjusting the optical distribution of the light fixture, the light fixture can emit light that mimics light from various non-LED light sources, such as metal halide, high intensity discharge, quartz, sodium, incandescent, and fluorescent light sources.

The light fixture typically includes a member having multiple surfaces disposed along a perimeter thereof. Typically, the surfaces are disposed at least partially around a channel or elongated structure extending through the member. For example, the elongated structure can include a solid or hollow tubular structure used to mount the member within the light fixture or to house one or more wires electrically coupled to the LEDs. The member can have any shape, whether polar or non-polar, symmetrical or asymmetrical. For example, the member can have a frusto-conical or cylindrical shape.

The member can be solid or can include multiple components that are coupled together. For example, the member can include multiple modules coupled together by a cover or one or more fastening devices. Each module can include one or more of the surfaces. If a module breaks or otherwise requires service, the module may easily be replaced by exchanging the module with a different, working module. Replacement of one module does not substantially impact operation of the other modules. Therefore, service times and costs associated with a modular member may be less than that of a solid member.

Each surface is configured to receive at least one LED. For example, each surface can receive one or more LEDs in a linear or non-linear array. Each surface can be integral to the member or coupled thereto. For example, the surfaces can be formed on the member via molding, casting, extrusion, or die-based material processing. Alternatively, the surfaces can be mounted or attached to the member by solder, braze, welds, glue, plug-and-socket connections, epoxy, rivets, clamps, fasteners, or other fastening means.

Each LED can be removably coupled to a respective one of the surfaces. For example, each LED can be mounted to its respective surface via a substrate that includes one or more sheets of ceramic, metal, laminate, or another material. Alternatively, one or more circuitry elements from each LED can be mounted directly to the LED's respective surface without using a substrate or other intermediate material.

The optical distribution of the light fixture can be adjusted by changing the output direction and/or intensity of one or more of the LEDs. In other words, the optical distribution of the light fixture can be adjusted by mounting additional LEDs to certain surfaces, removing LEDs from certain surfaces, and/or by changing the position and/or configuration of one or more of the LEDs across the surfaces or along particular surfaces. For example, one or more of the LEDs can be repositioned along a different surface, repositioned in a different location along the same surface, removed from the member, or reconfigured to have a different level of electric power to adjust the optical distribution of the light fixture. A given light fixture can be adjusted to have any number of optical distributions. Thus, the light fixture provides flexibility in establishing and adjusting optical distribution.

As a byproduct of converting electricity into light, LEDs generate a substantial amount of heat. Accordingly, the member can be configured to manage heat output by the LEDs. For example, if present, the channel extending through the member can be configured to transfer the heat output from the LEDs by convection. Heat from the LEDs is transferred by conduction to the surfaces and to the channel, which convects the heat away. For example, the channel can transfer heat by the venturi effect. The shape of the channel can correspond to the shape of the member. For example, if the member has a frusto-conical shape, the channel can have a wide top end and a narrower bottom end. Alternatively, the shape of the channel can be independent of the shape of the member.

Fins can be disposed within the channel to assist with the heat transfer. For example, the fins can extend from the surfaces into the channel, towards a core region of the member. The core region can include a point where the fins converge. In addition, or in the alternative, the core region can include a member disposed within and extending along the channel and having a shape defining a second, inner channel that extends through the member. The fins can be configured to transfer heat by conduction from the facets to the inner channel. Like the outer channel, the inner channel can be configured to transfer at least a portion of that heat through convection. This air movement assists in dissipating heat generated by the LEDs.

In addition, or in the alternative, one or more heat pipes or vapor chambers can extend through, or come in contact with, the member to transfer heat from the LEDs. For simplicity, the term "heat pipe" is used herein to refer to a heat pipe, vapor chamber, or similar device. For example, each heat pipe can extend between a top end of the member and a bottom end of the member, substantially parallel to a longitudinal axis of the member and/or a longitudinal axis of a corresponding one of the surfaces of the member. At least a portion of each heat pipe is surrounded by a material of the member so that an outside perimeter of the heat pipe engages an inside surface of the member. Each heat pipe includes a sealed pipe or tube made of a thermally conductive material, such as copper or aluminum. A cooling fluid, such as water, ethanol, acetone, sodium, or mercury, is disposed inside the heat pipe. Evaporation and condensation of the cooling fluid causes thermal energy to transfer from a first, higher temperature portion of the heat pipe (proximate one or more corresponding LEDs) to a second, lower temperature portion of the heat pipe (away from the one or more corresponding LEDs). For example, the cooling fluid can cause thermal energy to transfer from a top end of the heat pipe to a bottom end of the heat pipe.

The transferred heat can be dissipated from the heat pipe through convection or conduction. For example, the transferred heat can be convected directly from the second portion of the heat pipe to a surrounding environment. In some cases, one or more fins can be integral or coupled to the second portion of each heat pipe to help dissipate the transferred heat, substantially as described above. In addition, or in the alternative, one or more of the heat pipes can be coupled to an active cooling module (or "forced convection" cooling module), such as a SynJet™ brand module offered by Nuventix, Inc.

In certain exemplary embodiments, each heat pipe or vapor chamber includes a sealing chamber, a working fluid, and possibly a wick. The sealing chamber includes evaporation (hot), adiabatic, and condensation (cold) regions. Heat primarily passes into and out of the heat pipe or vapor chamber through the evaporation and condensation regions. The adiabatic region transfers heat from the evaporation region to the condensation region via the movement of heat carrying vapor of the working fluid with little no decrease in temperature. The adiabatic region also can transport heat away from the emission area of the LEDs to a heat sink or other heat management device.

The evaporation, adiabatic, and condensation regions can be comprised of the same material or a combination of different materials. For example, the regions can be comprised of stainless steel, aluminum, copper, and/or another material. The walls of the evaporation and condensation regions must be sufficiently thin or have high enough conductivity as to not impede the conductive transfer of heat to and from the working fluid. The walls of the adiabatic region can be thicker and of lower conductivity than those of the evaporation and condensation regions. The walls also can be made of a flexible material. The inside of the vapor chamber is evacuated of all other fluids besides the working fluid in its liquid and gas phases.

The working fluid is chosen based on the temperature range needed for the application. In typical LED applications, the working fluid can be water, methanol, or ammonia. For extreme temperature applications, mercury, sodium, or liquid nitrogen can be used. During operation, heat from the LEDs passes through the walls of the heat pipe or vapor chamber to the working fluid inside. The latent heat of vaporation boils the working fluid. The vapor expands, traveling through the adiabatic region to the condensation region, where the latent heat of condensation condenses the vapor. The heat then passes through the chamber walls of the condensation region. In certain exemplary embodiments, the heat can pass from the chamber walls to a heat sink or heat management device. The fluid then returns to the evaporation region via gravity if the condensation region is at a higher elevation than the evaporation region. In applications where the condensation region is not at a higher elevation or there are too many bends in the chamber that obstruct flow, a wick can be inserted into the chamber. The wick can be a groove, sintered powder, fine fiber, screen mesh or any other material that uses capillary action to transport the working fluid in liquid form from the condensation region to the evaporation region.

These and other aspects, features and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the present invention and the advantages thereof, reference is now made to the following description, in conjunction with the accompanying figures briefly described as follows.

DETAILED DESCRIPTION OF EXEMPLARY EMBODIMENTS

The present invention is directed to systems for adjusting optical distribution of a light fixture. In particular, the invention provides efficient, user-friendly, and cost-effective systems for adjusting optical distribution of a light fixture. The term "optical distribution" is used herein to refer to the spatial or geographic dispersion of light within an environment, including a relative intensity of the light within one or more regions of the environment.

Figure 1:
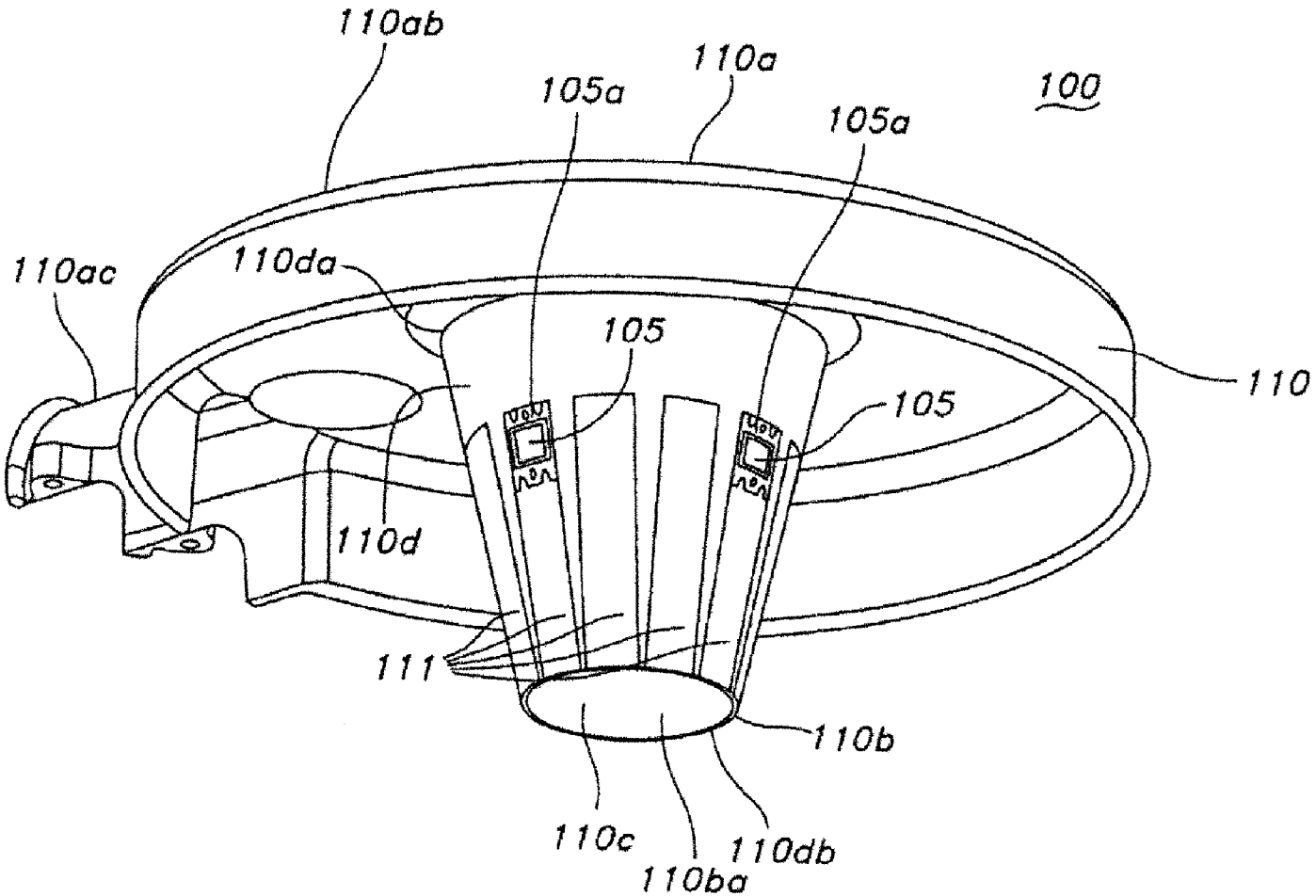
FIG. 1 is a perspective view of a light fixture with an optical distribution capable of being adjusted, according to certain exemplary embodiments.
Figure 2:
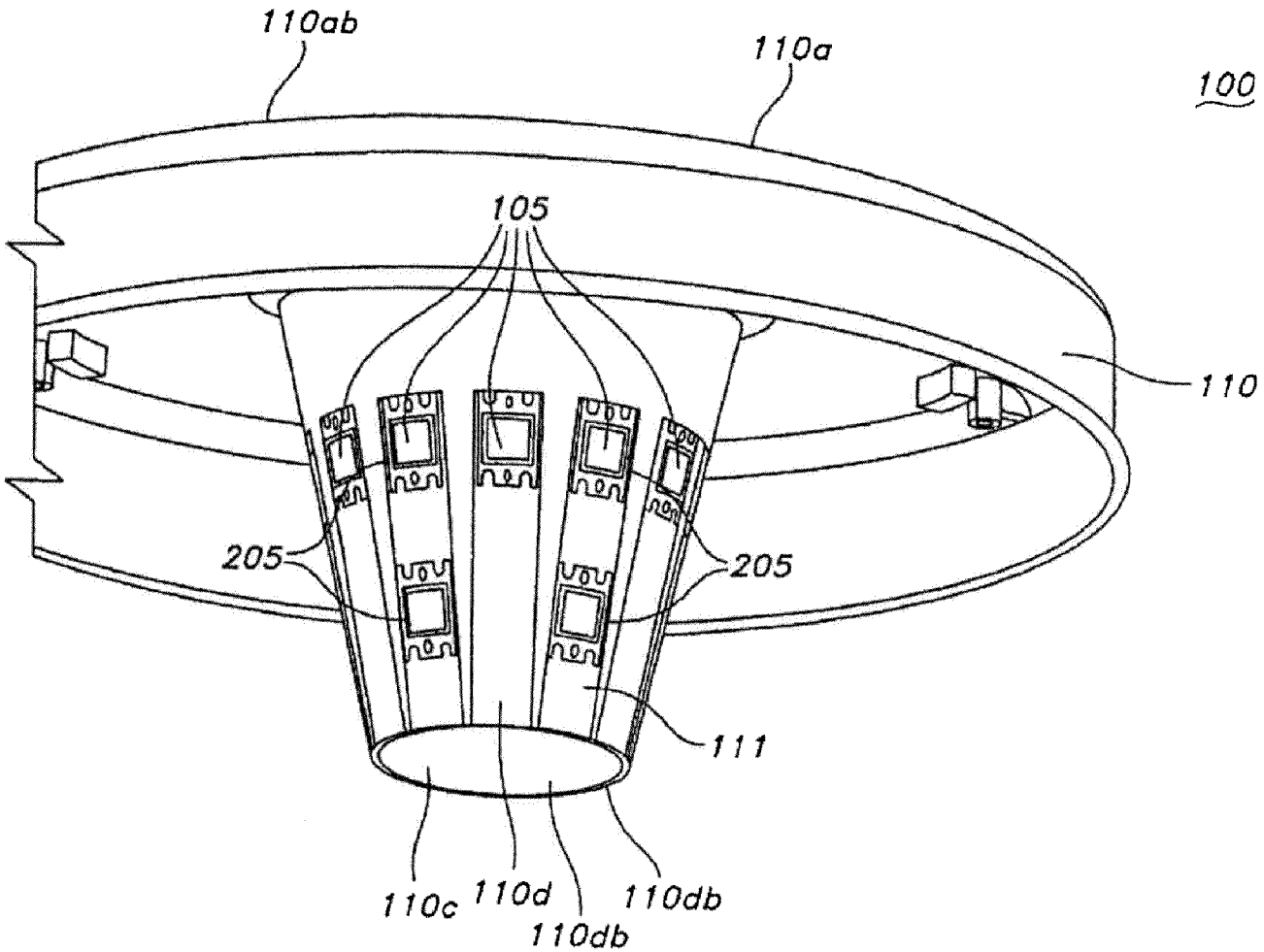
FIG. 2 is another perspective view of the exemplary light fixture of FIG. 1, wherein the light fixture has a different optical distribution than that illustrated in FIG. 1.

Turning now to the drawings, in which like numerals indicate like elements throughout the figures, exemplary embodiments of the invention are described in detail. FIG. 1 is a perspective view of a light fixture 100 with an optical distribution capable of being adjusted, according to certain exemplary embodiments. FIG. 2 is another perspective view of the light fixture 100, wherein the light fixture 100 has a different optical distribution than that illustrated in FIG. 1. With reference to FIGS. 1 and 2, the light fixture 100 is an electrical device configured to create artificial light or illumination in an indoor and/or outdoor environment. For example, the light fixture 100 is suited for mounting to a pole (not shown) or similar structure, for use as a street light.

In the exemplary embodiments depicted in FIGS. 1 and 2, the light fixture 100 is configured to create artificial light or illumination via one or more LEDs 105. For purposes of this application, each LED 105 may be a single LED die or may be an LED package having one or more LED dies on the package. In one exemplary embodiment, the number of dies on each LED package ranges from 1-312. Each LED 105 is mounted to an outer surface 111 of a housing 110. The housing 110 includes a top end 110*a* and a bottom end 110*b*. Each end 110*a* and 110*b* includes an aperture 110*aa* (FIG. 4) and 110*ba*, respectively. A channel 110*c* extends through the housing 110 and connects the apertures 110*aa* and 110*ba*. The top end 110*a* includes a substantially round top surface 110*ab* disposed around the channel 110*c*. A mounting member 111*ac* extends outward from the top surface 110*ab*, in a direction away from the channel 110*c*. The mounting member 110*ac* is configured to be coupled to the pole, for mounting the light fixture 100 thereto.

In certain exemplary embodiments, a light-sensitive photocell 310 is coupled to the mounting member 110*ac*. The photocell 310 is configured to change electrical resistance in a circuit that includes one or more of the LEDs 105, based on incident light intensity. For example, the photocell 310 can cause the LEDs 105 to output light at dusk but not to output light after dawn.

A member 110*d* extends downward from the top surface 110*ab*, around the channel 110*c*. The member 110*d* has a frusto-conical geometry, with a top end 110*da* and a bottom end 110*db* that has a diameter that is less than a diameter of the top end 110*da*. Each outer surface 111 includes a substantially flat, curved, angular, textured, recessed, protruding, bulbous, and/or other-shaped surface disposed along an outer perimeter of the member 110*d*. For simplicity, each outer surface 111 is referred to herein as a "facet." The LEDs 105 can be mounted to the facets 111 by solder, braze, welds, glue, plug-and-socket connections, epoxy, rivets, clamps, fasteners, or other means known to a person of ordinary skill in the art having the benefit of the present disclosure.

In the exemplary embodiments depicted in FIGS. 1 and 2, the housing 110 includes twenty facets 111. The number of facets 111 can vary depending on the size of the LEDs 105, the size of the housing 110, cost considerations, and other financial, operational, and/or environmental factors known to a person of ordinary skill in the art having the benefit of the present disclosure. As will be readily apparent to a person of ordinary skill in the art, a larger number of facets 111 corresponds to a higher level of flexibility in adjusting the optical distribution of the light fixture 100. In particular, as described below, each facet 111 is configured to receive one or more LEDs 105 in one or more positions. The greater the number of facets 111 present on the member 110*d*, the greater the number of LED 105 positions, and thus optical distributions, available.

In the embodiments depicted in FIGS. 1 and 2, the end 110*a* and member 110*d* are integral to the housing 110, and the facets 111 are integral to the member 110*d*. In certain exemplary embodiments, the housing 110 and/or the end 110*a*, member 110*d*, and/or facets 111 thereof can be formed via molding, casting, extrusion, or die-based material processing. For example, the housing 110 and facets 111 can be comprised of die-cast aluminum, extruded aluminum, copper, graphite composition, or any high conductivity material. In certain alternative exemplary embodiments, the end 110*a*, member 110*d*, and/or facets 111 include separate components coupled together to form the housing 110. For example, the facets 111 can be mounted or attached to the member 110*d* by solder, braze, welds, glue, plug-and-socket connections, epoxy, rivets, clamps, fasteners, or other attachment means known to a person of ordinary skill in the art having the benefit of the present disclosure.

Each facet 111 is configured to receive a column of one or more LEDs 105. The term "column" is used herein to refer to an arrangement or a configuration whereby one or more LEDs 105 are disposed approximately in or along a line. LEDs 105 in a column are not necessarily in perfect alignment with one another. For example, one or more LEDs 105 in a column might be slightly out of perfect alignment due to manufacturing tolerances or assembly deviations. In addition, LEDs 105 in a column might be purposely staggered in a non-linear or non-continuous arrangement. Each column extends along an axis of its associated facet 111.

In certain exemplary embodiments, each LED 105 is mounted to its corresponding facet 111 via a substrate 105*a*. Each substrate 105*a* includes one or more sheets of ceramic, metal, laminate, circuit board, mylar, or other material. Each LED 105 is attached to its respective substrate 105*a* by a solder joint, a plug, an epoxy or bonding line, or other suitable provision for mounting an electrical/optical device on a surface. Each LED 105 includes semi-conductive material that is treated to create a positive-negative ("p-n") junction. When the LEDs 105 are electrically coupled to a power source, such as a driver (not shown), current flows from the positive side to the negative side of each junction, causing charge carriers to release energy in the form of incoherent light.

The wavelength or color of the emitted light depends on the materials used to make each LED 105. For example, a blue or ultraviolet LED typically includes gallium nitride ("GaN") or indium gallium nitride ("InGaN"), a red LED typically includes aluminum gallium arsenide ("AlGaAs"), and a green LED typically includes aluminum gallium phosphide ("AlGaP"). Each of the LEDs 105 is capable of being configured to produce the same or a distinct color of light. In certain exemplary embodiments, the LEDs 105 include one or more white LEDs and one or more non-white LEDs, such as red, yellow, amber, green, or blue LEDs, for adjusting the color temperature output of the light emitted from the light fixture 100. A yellow or multi-chromatic phosphor may coat or otherwise be used in a blue or ultraviolet LED 105 to create blue and red-shifted light that essentially matches blackbody radiation. The emitted light approximates or emulates "white," light to a human observer. In certain exemplary embodiments, the emitted light includes substantially white light that seems slightly blue, green, red, yellow, orange, or some other color or tint. In certain exemplary embodiments, the light emitted from the LEDs 105 has a color temperature between 2500 and 6000 degrees Kelvin.

In certain exemplary embodiments, an optically transmissive or clear material (not shown) encapsulates at least some of the LEDs 105, either individually or collectively. This encapsulating material provides environmental protection while transmitting light from the LEDs 105. For example, the encapsulating material can include a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light.

Figure 3:
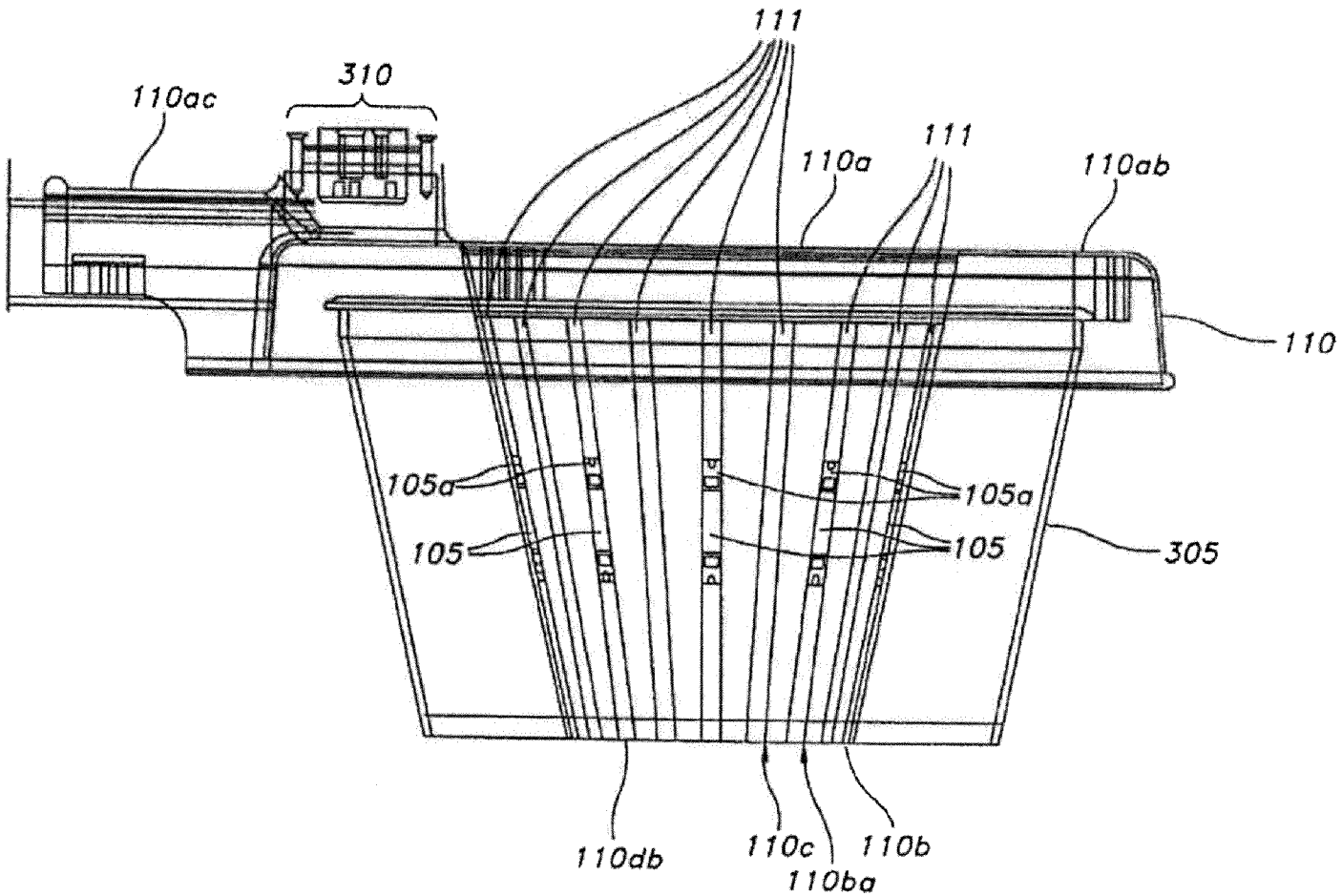
FIG. 3 is a side elevational view of a light fixture with an optical distribution capable of being adjusted, according to certain alternative exemplary embodiments.

The optical distribution of the light fixture 100 depends on the positioning and configuration of the LEDs 105 within the facets 111. For example, as illustrated in FIG. 1 and FIG. 3, described below, positioning multiple LEDs 105 symmetrically along the outer perimeter of the member 110*d*, in a polar array, can create a type V symmetric distribution of light. Outdoor area and roadway luminaires are designed to distribute light over different areas, classified with designations I, II, 111, IV, and V. Generally, type II distributions are wide, asymmetric light patterns used to light narrow roadways (i.e. 2 lanes) from the edge of the roadway. Type III asymmetric distributions are not quite as wide as type II distributions but throw light further forward for wider roadways (i.e. 3 lanes). Similarly, a type IV asymmetric distribution is not as wide as the type III distribution but distributes light further forward for wider roadways (4 lanes) or perimeters of parking lots. A type V distribution produces a symmetric light pattern directly below the luminaire, typically either a round or square pattern of light. For example, positioning LEDs 105 only in three adjacent facets 111 can create a type IV asymmetric distribution of light.

As illustrated in FIG. 2, positioning multiple LEDs 105 in the same facet 111 increases directional intensity of the light relative to the facet 111 (as compared to a facet 111 with only one or no LEDs 105). For example, positioning the LEDs 105 in a linear array 205 along the facet 111 increases directional intensity of the light substantially normal to the axis of the facet 111. Directional intensity also can be adjusted by increasing or decreasing the electric power to one or more of the LEDs 105. For example, overdriving one or more LEDs 105 increases the directional intensity of the light from the LEDs 105 in a direction normal to the corresponding facet 111. Similarly, using LEDs 105 with different sizes and/or wattages can adjust directional intensity. For example, replacing an LED 105 with another LED 105 that has a higher wattage can increase the directional intensity of the light from the LEDs 105 in a direction normal to the corresponding facet 111.

The optical distribution of the light fixture 100 can be adjusted by changing the output direction and/or intensity of one or more of the LEDs 105. In other words, the optical distribution of the light fixture 100 can be adjusted by mounting additional LEDs 105 to the member 110*d*, removing LEDs 105 from the member 110*d*, and/or by changing the position and/or configuration of one or more of the LEDs 105. For example, one or more of the LEDs 105 can be repositioned in a different facet 111, repositioned in a different location within the same facet 111, removed from the light fixture 100, or reconfigured to have a different level of electric power. A given light fixture 100 can be adjusted to have any number of optical distributions.

For example, if a particular lighting application only requires light to be emitted towards one direction, LEDs 105 can be placed only on facets 111 corresponding to that direction. If the intensity of the emitted light in that direction is too low, the electric power to the LEDs 105 may be increased, and/or additional LEDs 105 may be added to those facets 111. Similarly, if the intensity of the emitted light in that direction is too high, the electric power to the LEDs 105 may be decreased, and/or one or more of the LEDs 105 may be removed from the facets 111. If the lighting application changes to require a larger beam spread of light in multiple directions, additional LEDs 105 can be placed on empty, adjacent facets 111. In addition, the beam spread may be tightened by moving one or more of the LEDs 105 downward within their respective facets 111, towards the bottom end 110*db*. Similarly, the beam spread may be broadened by moving one or more of the LEDs 105 upwards within their respective facets 111, towards the top end 110*da*. Thus, the light fixture 100 provides flexibility in establishing and adjusting optical distribution.

Although illustrated in FIGS. 1 and 2 as having a frusto-conical geometry, a person of ordinary skill in the art having the benefit of the present disclosure will recognize that the member 110*d* can have any shape, whether polar or non-polar, symmetrical or asymmetrical. For example, the member 110*d* can have a cylindrical shape. Similarly, although illustrated as having a substantially vertical orientation, each facet 111 may have any orientation, including, but not limited to, a horizontal or angular orientation, in certain alternative exemplary embodiments.

The level of light a typical LED 105 outputs depends, in part, upon the amount of electrical current supplied to the LED 105 and upon the operating temperature of the LED 105. Thus, the intensity of light emitted by an LED 105 changes when electrical current is constant and the LED's 105 temperature varies or when electrical current varies and temperature remains constant, with all other things being equal. Operating temperature also impacts the usable lifetime of most LEDs 105.

As a byproduct of converting electricity into light, LEDs 105 generate a substantial amount of heat that raises the operating temperature of the LEDs 105 if allowed to accumulate on the LEDs 105, resulting in efficiency degradation and premature failure. The member 110*d* is configured to manage heat output by the LEDs 105. Specifically, the frusto-conical shape of the member 110*d* creates a venturi effect, drawing air through the channel 110*c*. The air travels from the bottom end 110*db* of the member 110*d*, through the channel 110*c*, and out the top end 110*da*. This air movement assists in dissipating heat generated by the LEDs 105. Specifically, the air dissipates the heat away from the member 110*d* and the LEDs 105 thereon. Thus, the member 110*d* acts as a heat sink for the LEDs 105 positioned within or along the facets 111.

FIG. 3 is a side elevational view of a light fixture 300 with an optical distribution capable of being adjusted. The light fixture 300 is identical to the light fixture 100 of FIGS. 1 and 2 except that the light fixture 300 includes a cover 305. The cover 305 is an optically transmissive element that provides protection from dirt, dust, moisture, and the like. The cover 305 is disposed at least partially around the facets 111, with a top end thereof being coupled to the top surface 110*ab* of the housing 110. In certain exemplary embodiments, the cover 305 is configured to control light from the LEDs 105 via refraction, diffusion, baffles, louvers, or the like. For example, the cover 305 can include a refractor, a lens, an optic, or a milky plastic or glass element.

Figure 4:
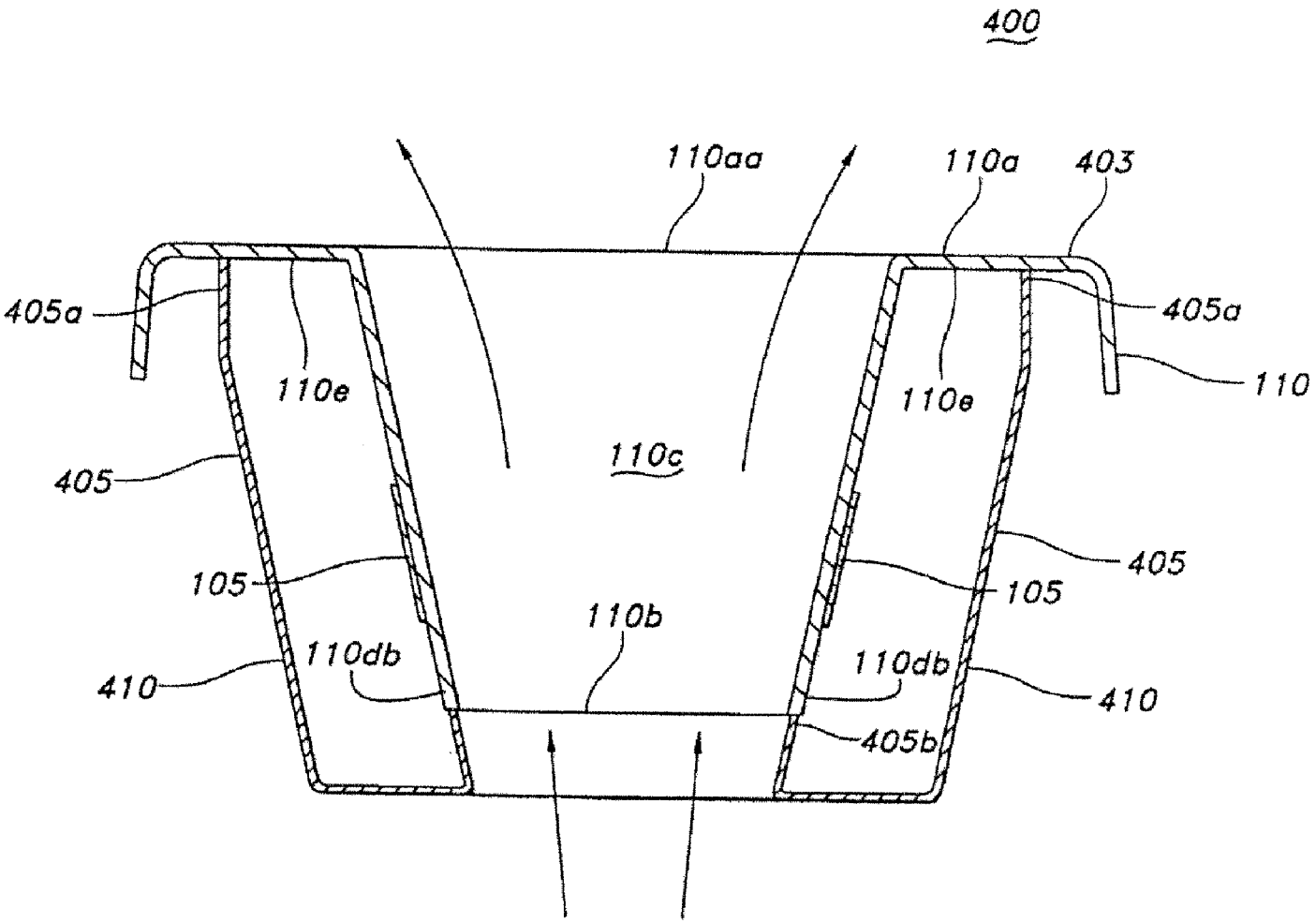
FIG. 4 is a cross-sectional side view of a light fixture with an optical distribution capable of being adjusted, according to certain other alternative exemplary embodiments.

FIG. 4 is a cross-sectional side view of a light fixture 400 with an optical distribution capable of being adjusted, according to another alternative exemplary embodiment. Like the light fixture 300 of FIG. 3, the light fixture 400 is identical to the light fixture 100 of FIGS. 1 and 2 except that the light fixture 400 includes a cover 405. The cover 405 includes an optically transmissive element 410 that provides protection from dirt, dust, moisture, and the like. The cover 405 is disposed at least partially around the facets 111, with a top end 405*a* thereof being attached to a bottom surface 110*e* of the top end 110*a* of the housing 110. For example, the top end 405*a* can be attached to one or more ledges 520 (shown in FIG. 5) extending from the bottom surface 110*e* of the housing 110. Another end 405*b* of the cover 405 is attached to the bottom end 110*db* of the member 110*d*. In certain exemplary embodiments, there is a sealing element (not shown) between the cover 405 and the member 110*d*, at one or more points of attachment. In certain exemplary embodiments, the cover 405 is configured to control light from the LEDs 105 via refraction, diffusion, baffles, louvers, or the like. For example, the cover 405 can include a refractor, a lens, an optic, or a milky plastic or glass element.

Figure 5:
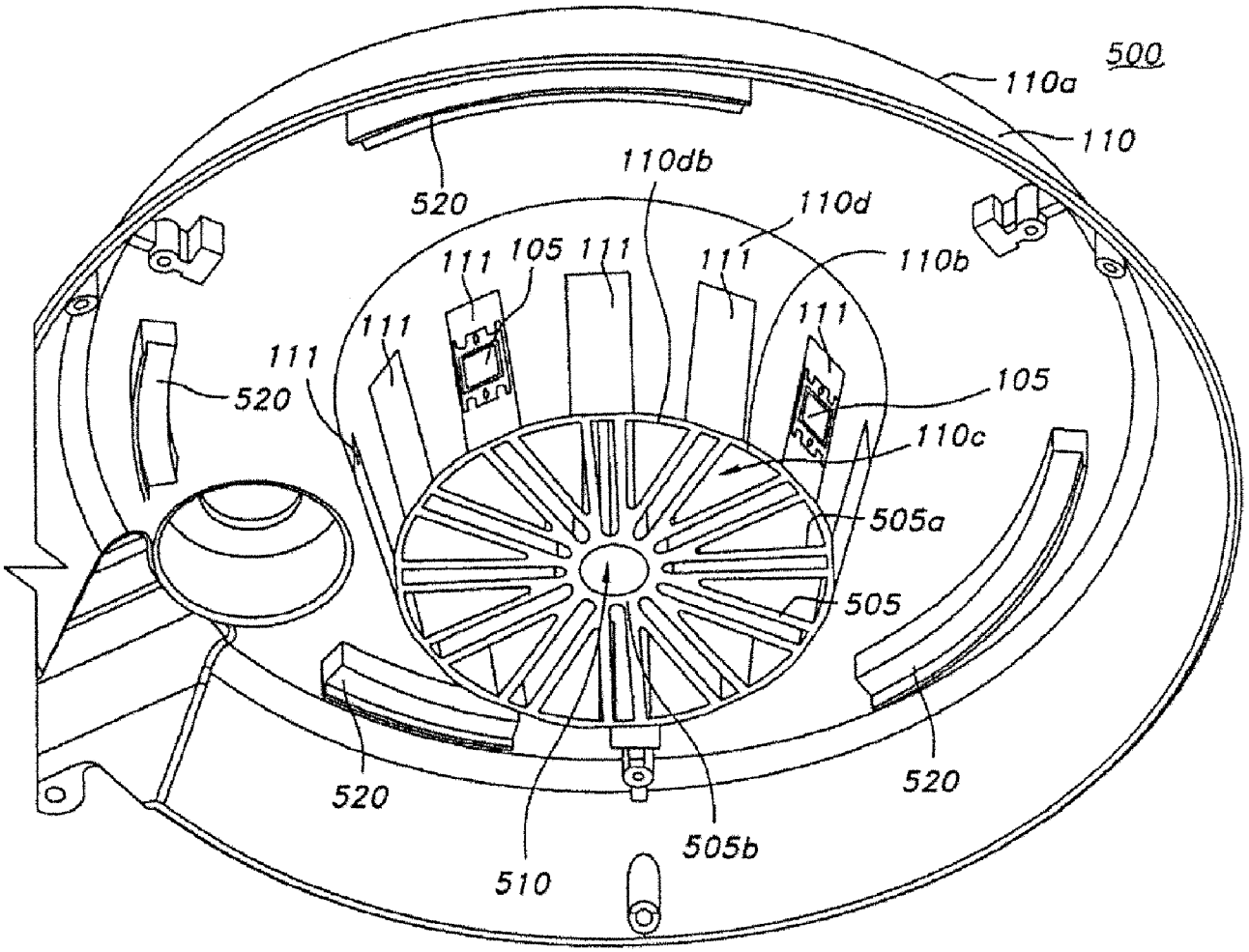
FIG. 5 is a perspective view of a light fixture with an optical distribution capable of being adjusted, according to yet other alternative exemplary embodiments.

FIG. 5 is a perspective view of a light fixture 500 with an optical distribution capable of being adjusted, according to yet another alternative exemplary embodiment. The light fixture 500 is identical to the light fixture 100 of FIGS. 1 and 2 except that the light fixture 500 includes one or more fins 505 acting as heat sinks for managing heat produced by the LEDs 105. In certain exemplary embodiments, each fin 505 is associated with a facet 111 and includes an elongated member 505*a* that extends from an interior surface (of the member 110*d*) opposite its associated facet 111, within the channel 110*c*, to a core region 505*b*. A channel 510 extends through the core region 505*b*, within the channel 110*c*. The fins 505 are spaced annularly around the channel 510. Alternatively, one or more of the fins 505 can be independent of the facets 111 and can be positioned radially in a symmetrical or non-symmetrical pattern.

Heat transfers from the LEDs 105 via a heat-transfer path extending from the LEDs 105, through the member 110*d*, and to the fins 505. For example, the heat 105 from a particular LED 105 transfers from the substrate 105*a* of the LED 105 to its corresponding facet 111, and from the facet 111 through the member 110*d* to the corresponding fin 505. The fins 505 receive the conducted heat and transfer the conducted heat to the surrounding environment (typically air) via convection.

The channel 510 supports convection-based cooling. For example, as described above in connection with FIGS. 1 and 2, the frusto-conical shape of the member 110*d* creates a venturi effect, drawing air through the channel 510. The air travels from the bottom end 110*b* of the housing 110, through the channel 510, and out the top end 110*a*. This air movement assists in dissipating heat generated by the LEDs 105 away from the LEDs 105. In certain alternative exemplary embodiments, the fins 505 converge within the channel 110*c* so that there is not an inner channel 510 within the channel 110*c*. In such an embodiment, the channel 110*c* supports convection-based cooling substantially as described above.

In the embodiment depicted in FIG. 5, the fins 505 are integral to the member 110*d*. In certain exemplary embodiments, the fins 505 can be formed on the member 110*d* via molding, casting, extrusion, or die-based material processing. For example, the member 110*d* and fins 505 can be comprised of die-cast aluminum. Alternatively, the fins 505 can be mounted or attached to the member 110*d* by solder, braze, welds, glue, plug-and-socket connections, epoxy, rivets, clamps, fasteners, or other fastening means known to a person of ordinary skill in the art having the benefit of the present disclosure. Like the light fixtures 300 and 400 of FIGS. 3 and 4, respectively, in certain alternative exemplary embodiments, the light fixture 500 can be modified to include a cover (not shown).

Although illustrated in FIG. 5 as having a frusto-conical geometry, a person of ordinary skill in the art having the benefit of the present disclosure will recognize that the member 110*d* can have any shape, whether polar or non-polar, symmetrical or asymmetrical. For example, the member 110*d* can have a cylindrical shape.

Figure 6:
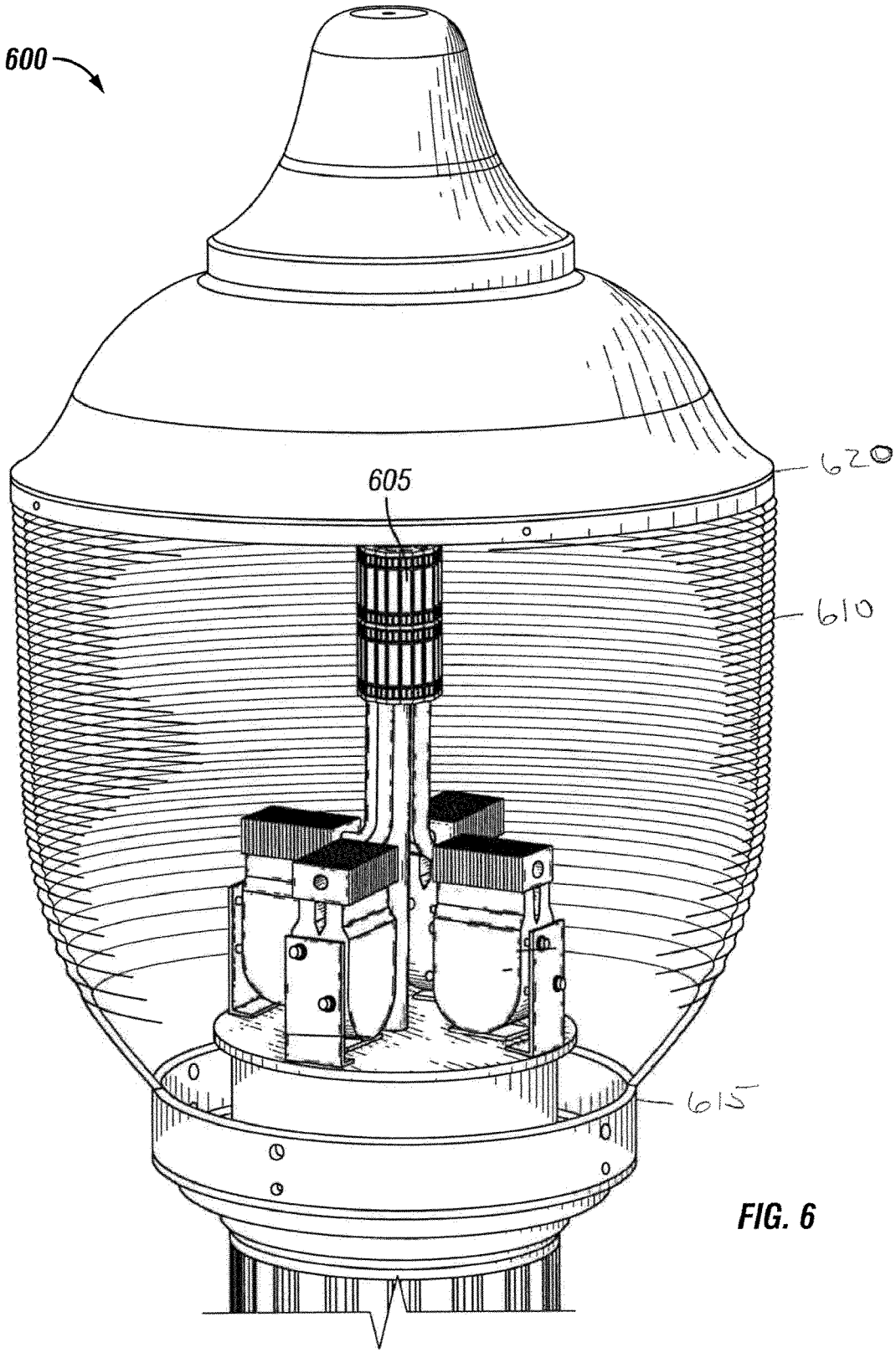
FIG. 6 is a perspective side view of a light fixture with an optical distribution capable of being adjusted, according to yet other alternative exemplary embodiments.
Figure 7:
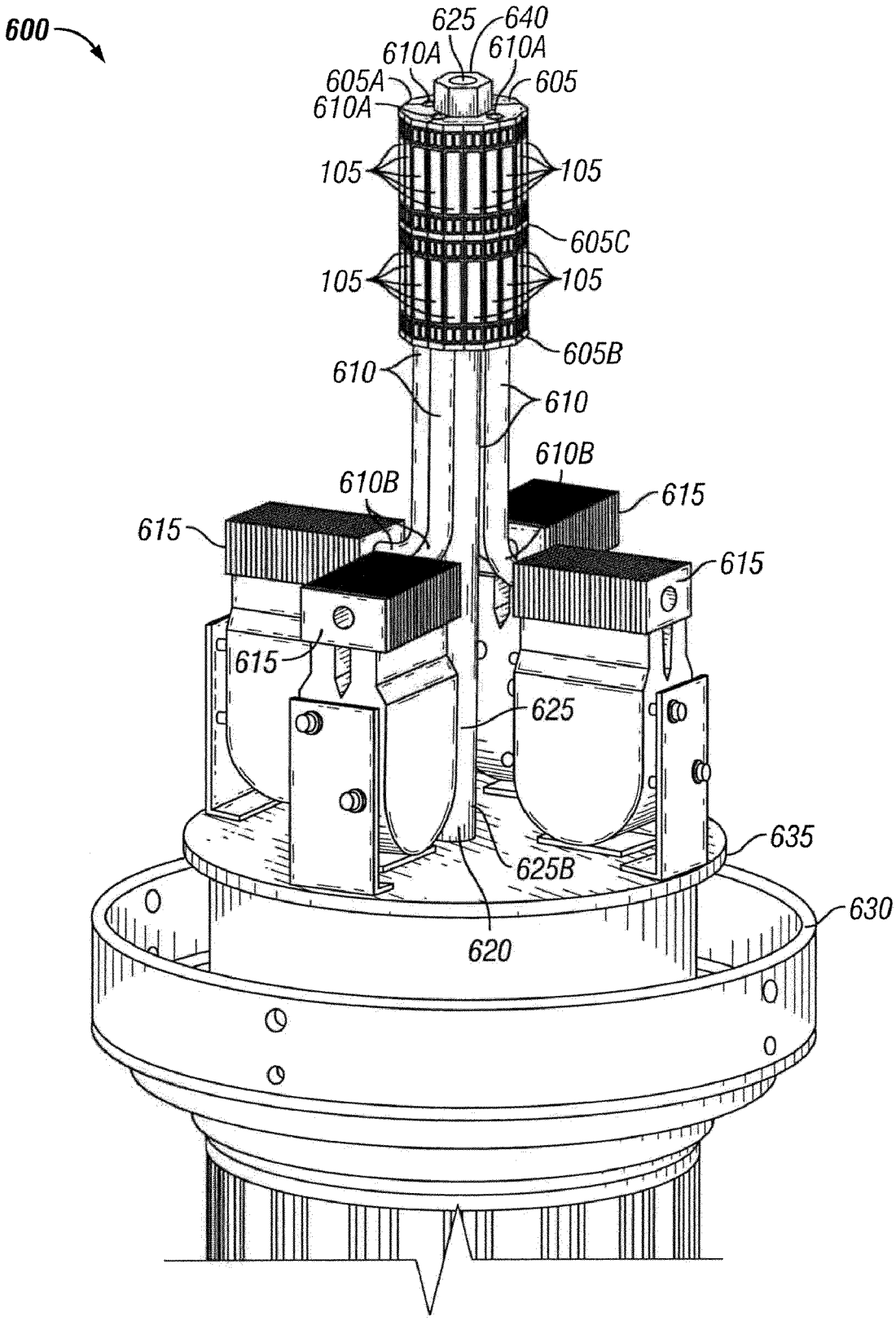
FIG. 7 is a perspective side view of the light fixture of FIG. 6 with certain components removed for clarity.

FIG. 6 is a perspective view of a light fixture 600 with an optical distribution capable of being adjusted, according to yet another alternative exemplary embodiment. FIG. 7 is another perspective view of the light fixture 600 of FIG. 6 with certain components removed for clarity. With reference to FIGS. 6 and 7, the light fixture 600 is similar to the light fixtures described above in connection with FIGS. 1-5, except that the light fixture 600 includes a substantially solid, cylindrical core member 605 instead of a frusto-conical shaped housing, and the light fixture 600 includes heat pipes 610 and active cooling modules 615 for heat management.

Figure 8:
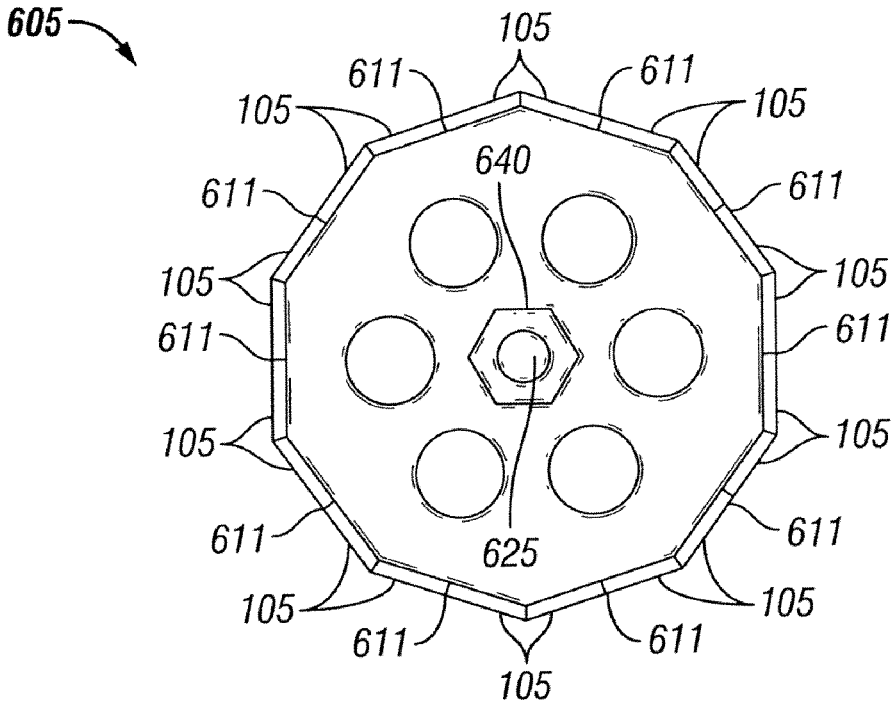
FIG. 8 is an elevational top view of a core member of the light fixture of FIG. 6, according to certain exemplary embodiments.

FIG. 8 is a top view of the core member 605, according to certain exemplary embodiments. With reference to FIGS. 6-8, the core member 605 has a top end 605*a*, a bottom end 605*b*, and a body 605*c* that extends between the top end 605*a* and the bottom end 605*b*. The body 605*c* includes multiple outer surfaces 611 or "facets" spaced azimuthally along an outer perimeter thereof. Like the facets 111 described above in connection with FIGS. 1 and 2, each facet 611 includes a substantially flat, curved, angular, textured, recessed, protruding, bulbous, and/or other-shaped surface. In the embodiment depicted in FIGS. 6 and 7, the facets 611 are integral to the member 605. The integral facets 611 can be formed on the member 605 via molding, casting, extrusion, die-based material processing, or other means for forming a surface on a material known to a person of ordinary skill in the art having the benefit of the present disclosure. For example, the member 605 and facets 611 can be formed with die-cast aluminum. Alternatively, the member 605 and the facets 611 can be formed from any thermally conductive material including, but not limited to, copper and ceramic. In certain alternative exemplary embodiments, the body 605*c* and facets 611 can include separate components coupled together to form the member 605. For example, the facets 611 can be mounted or attached to the body 605*c* by solder, braze, welds, glue, plug-and-socket connections, epoxy, rivets, clamps, fasteners, or other attachment means known to a person of ordinary skill in the art having the benefit of the present disclosure.

As with the facets 111 of FIGS. 1-5, each facet 611 is configured to receive at least one column of LEDs 105. As described above, the LEDs 105 can be arranged in various different positions, with various different electrical and other configurations. This flexibility in arrangement and configuration of the LEDs 105 allows the light fixture 600 to have many different optical distributions. For example, as described below, at least some of the optical distributions can correspond to optical distributions of non-LED light sources, such as metal halide, high intensity discharge, quartz, sodium, incandescent, and fluorescent light sources. Thus, the light fixture 600 may be used in many different lighting applications, including applications in which LED light sources traditionally have not been used. Manipulation of the positions of LEDs 105 in the facets 611 allows the light fixture 600 to have any type of light distribution, such as a symmetric or asymmetric type I, II, III, IV, or V light distribution. In certain exemplary embodiments, one or more LEDs 105 also may be coupled to the top end 605*a* of the member 605 to provide additional flexibility with regard to the optical distribution of the fixture 600.

The LEDs 105 are mounted to the facets 611 (and/or member 605) by solder, braze, welds, glue, plug-and-socket connections, epoxy, rivets, clamps, fasteners, or other means known to a person of ordinary skill in the art having the benefit of the present disclosure. Each LED 105 is mounted to its respective facet 611 directly or via a substrate 105*a* that includes one or more sheets of ceramic, metal, laminate, or another material, such as a printed circuit board (PCB) or a metal core printed circuit board (MPCB). For example, each LED 105 can be attached to its respective substrate 105*a* by a solder joint, a plug, an epoxy or bonding line, or another suitable provision for mounting an electrical/optical device on a surface. Similarly, if a substrate 105*a* is not used, one or more circuitry elements (not shown) of each LED 105 can be attached directly to its respective facet 611 by a solder joint, a plug, an epoxy or bonding line, or another suitable provision for mounting an electrical/optical device on a surface.

In the exemplary embodiment depicted in FIGS. 6 and 7, the member 605 has a diameter of about 1.8 inches, a length (between the top end 605*a* to the bottom end 605*b*) of about three inches, and a total of ten facets 611. The size of the member 605 and the number of facets 611 can vary depending on the size of the LEDs 105, the size of the light fixture 600, cost considerations, and other financial, operational, and/or environmental factors known to a person of ordinary skill in the art having the benefit of the present disclosure. For example, the diameter of the member 605 can range between less than one inch up to one foot and, in alternative embodiments, the diameter of the member is about six inches. Further, the length of the member 605 can range anywhere between less than an inch to over twelve feet, and is contemplated to be provided in four foot and eight foot length options to mimic fluorescent tube lighting. As will be readily apparent to a person of ordinary skill in the art, a larger number of facets 611 corresponds to a higher level of flexibility in adjusting the optical distribution of the light fixture 600. In particular, the greater the number of facets 611 on the member 605, the greater the number of LED 105 positions, and thus optical distributions, available.

An elongated structure 620 extends through an interior portion or center of the member 605, along a longitudinal axis thereof. The elongated structure 620 includes a solid or hollow tubular member 625 that secures the member 605 to the light fixture 600. For example, a top end 625*a* of the tubular member 625 can be integral to the member 605 or coupled to the member 605 via one or more threaded nuts 640, screws, nails, snaps, clips, pins, adhesives, or other fastening devices or materials. Similarly, a bottom end 625*b* of the tubular member 625 can be integral to or coupled to another component of the light fixture 600 via one or more threaded nuts, screws, nails, snaps, clips, pins, adhesives, or other fastening devices or materials. For example, the bottom end 625*b* can be mounted to a reflector housing 630 of the light fixture 600 via one or more brackets 635 or base plates that are integral or coupled to the bottom end 625*b*.

In certain exemplary embodiments, the tubular member 625 is hollow and defines a channel (not shown) that extends at least partially along the longitudinal axis of the member 605. The channel can house one or more wires (not shown) electrically coupled between the LEDs 105 and a driver (not shown), thereby shielding the wires from view. The driver supplies electrical power to, and controls operation of, the LEDs 105. For example, the wires can couple opposite ends of each substrate 105*a* or other circuitry element associated with each LED 105 to the driver, thereby completing one or more circuits between the driver and LEDs 105. In certain exemplary embodiments, the driver is configured to separately control one or more portions of the LEDs 105 to adjust light color and/or intensity. In certain alternative exemplary embodiments, there are multiple drivers that each control one or more of the LEDs 105. For example, each driver can control the LEDs 105 on one of the facets 611.

A person of ordinary skill in the art having the benefit of the present disclosure will recognize that, in alternative exemplary embodiments, the elongated structure 620 can be removed and/or replaced with other means for securing the member 605 within the light fixture 600. For example, in certain exemplary embodiments, the heat pipes 610 can secure the member 605 to the active cooling modules 615 without the need for any separate elongated structure 620.

The heat pipes 610 extend from the top end 605*a* to the bottom end 605*b* of the member 605, substantially parallel to the longitudinal axis of the member 605. At least a portion of each heat pipe 610 is surrounded by a portion of the member 605 so that an outside perimeter of the heat pipe 610 engages an inside surface of the member 605. Each heat pipe 610 includes a sealed pipe or tube made of a thermally conductive material, such as copper or aluminum. A cooling fluid (not shown), such as water, ethanol, acetone, sodium, or mercury, is disposed inside the heat pipe 610. Evaporation and condensation of the cooling fluid causes thermal energy to transfer from a first, higher temperature portion 610*a* of the heat pipe (proximate one or more corresponding LEDs 105) to a second, lower temperature portion 610*b* of the heat pipe (away from the one or more corresponding LEDs 105). For example, the cooling fluid causes thermal energy to transfer from a top end 610*a* to a bottom end 610*b* of the heat pipe 610. In certain exemplary embodiments, an internal wick (not shown) may be used to return the cooling fluid from the second portion to the first portion. If the second portion is disposed at a higher elevation than the first portion, gravity could be used to return the cooling fluid from the second portion to the first portion.

The transferred heat is dissipated from the heat pipe 610 through convection or conduction. For example, the transferred heat is convected directly from the bottom end 610*b* of the heat pipe 610 to a surrounding environment. In one exemplary embodiment, the number and size of the heat pipes 610 depends on the desired amount of heat energy to be dissipated, the size of the core member 605, cost considerations, and other financial, operational, and/or environmental factors known to a person of ordinary skill in the art having the benefit of the present disclosure. The number of heat pipes 610 also can be based on the number of sections present in a modular version of the core member 605, which is described below with reference to FIG. 16. For example, the four heat pipes 610 illustrated in FIGS. 6-8 are configured to dissipate a total of 140 Watts to 200 Watts of heat energy from the LEDs 105. In certain exemplary embodiments, one or more fins (not shown) can be integral or coupled to the bottom end 610*b* of each heat pipe 610 to help dissipate the transferred heat, substantially as described above in connection with the fins 505 of the light fixture 500 of FIG. 5. In addition, or in the alternative, one or more of the heat pipes 610 is coupled to an active cooling module 615, such as a SynJet™ brand module offered by Nuventix, Inc. Each active cooling module 615 expels high momentum pulses of air for spot cooling the heat pipes 610 and/or other components of the light fixture 600. The active cooling modules 615 also may generate air flow in an area that otherwise would have limited air flow due to the design of the light fixture.

The member 605 can be used in both new construction and retrofit applications. The retrofit applications can include placing the member 605 in an existing LED or non-LED light fixture. For example, the member 605 can be placed in a metal halide, high intensity discharge, quartz, sodium, incandescent, or fluorescent light fixture. Once inserted into the light fixture, the LEDs 105 can be positioned on the facets 611 of the member 605 to generate an optical distribution that mimics light typically output by such a non-LED light fixture. In certain exemplary embodiments, an optimal optical distribution of the member 605 can be obtained by adjusting the placement and/or configuration of the member 605 within the light fixture and/or by adjusting the placement and/or configuration of the LEDs 105 on the facets 611 of the member 605. The position of the member 605 within the light fixture may or may not correspond to a typical position of a non-LED light element within the light fixture. For example, if a fluorescent lamp traditionally has a horizontal position within a particular fluorescent light fixture, the member 605 may or may not be positioned horizontally when retro-fit within the fluorescent light fixture.

Figure 9:
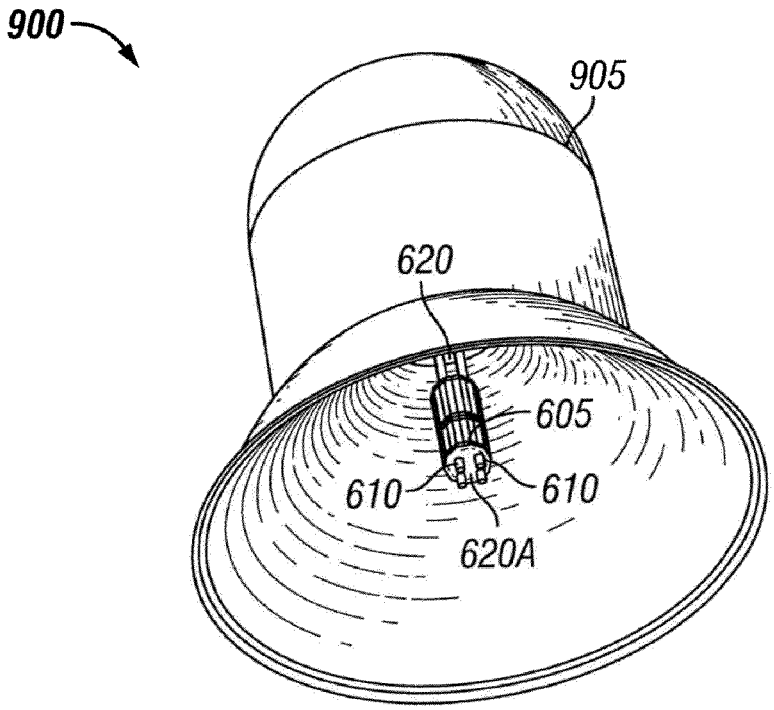
FIG. 9 is a perspective side view of another light fixture that includes the core member of FIG. 8, according to certain alternative exemplary embodiments.
Figure 10:
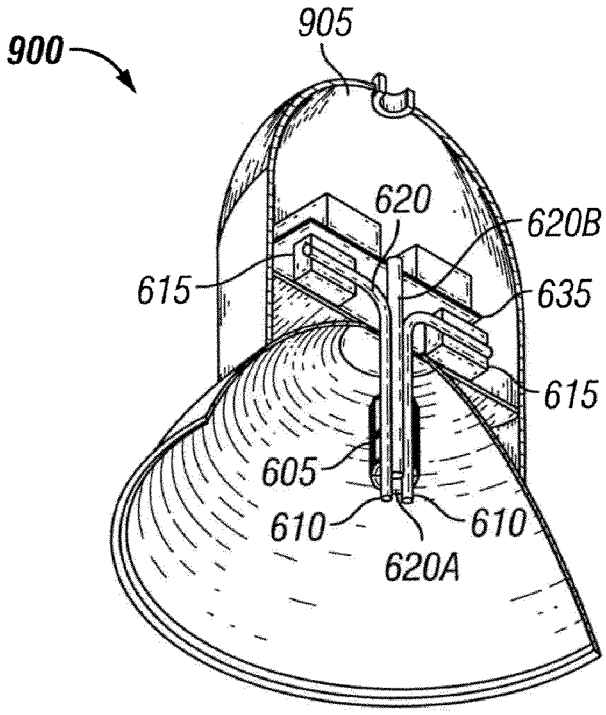
FIG. 10 is a perspective cross-sectional view of the light fixture of FIG. 9.
Figure 11:
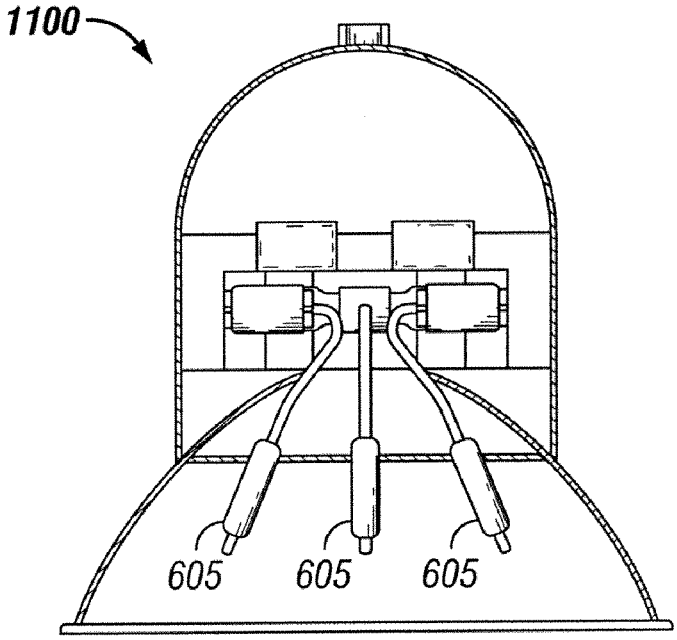
FIG. 11 is a cross-sectional view of another light fixture that includes the core member of FIG. 8, according to certain other alternative exemplary embodiments.

FIGS. 9-15 illustrate various light fixtures including the core member 605, according to certain alternative exemplary embodiments. Specifically, FIGS. 9-11 illustrate exemplary high bay light fixtures 900 and 1100, which include the core member 605. As shown in FIGS. 9 and 10, the high bay light fixture 900 includes a single core member 605 extending substantially along a center, longitudinal axis of the light fixture 900. The alignment of the core member 605 within the light fixture 900 substantially corresponds to a typical position of a high intensity discharge lamp that traditionally would be included in non-LED applications of the light fixture 900.

An elongated structure 620 secures the core member 605 within the light fixture 900, with a first end 620*a* of the elongated structure 620 being integral to or coupled to the member 605, and a second end 620*b* of the elongated structure 620 being integral to or coupled to a bracket 635 that is mounted within a housing 905 of the light fixture 900. Heat pipes 610 extend through at least a portion of the core member 605 (as described with regard to FIGS. 6-8) and into the housing 905. One or more fins (not shown) or active cooling modules 615 can be integral or coupled to an end of each heat pipe 610, within the housing 905, substantially as described above. Alternatively, one or more of the heat pipes 610 can be integral or coupled to the same active cooling module 615.

The high bay light fixture 1100 of FIG. 11 is similar to the light fixture 900 of FIG. 9, except that the light fixture 1100 includes multiple core members 605 that extend angularly relative to a central longitudinal axis of the light fixture 1100. The positions of the core members 605 within the light fixture 1100 do not correspond to a position of a high intensity discharge lamp that traditionally would be included in non-LED applications of the light fixture 1100. Nevertheless, the configurations and positions of the core member 605 may be such that the light output by the core members 605 still has an optical distribution that mimics that of a traditional high intensity discharge high bay light fixture. For example, the positions and configurations of the core members 605 and/or the LEDs 105 thereon can be adjusted to allow the light fixture 1100 to have an optical distribution similar to (or different than) that of a traditional high intensity discharge high bay light fixture.

Figure 12:
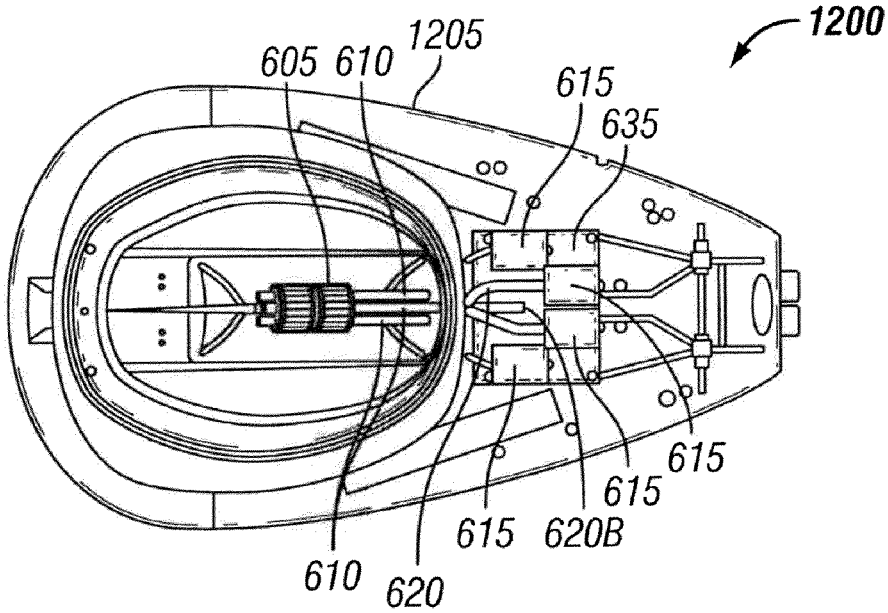
FIG. 12 is a horizontal cross-sectional view of another light fixture that includes the core member of FIG. 8, according to yet other alternative exemplary embodiments.

FIG. 12 illustrates an exemplary cobra head light fixture 1200, which includes the core member 605. The cobra head light fixture 1200 typically includes a single core member 605 extending substantially along a center, longitudinal axis of the light fixture 1200. In one exemplary embodiment, the alignment of the core member 605 within the light fixture 1200 substantially corresponds to a typical position of a metal halide or high pressure sodium lamp that traditionally would be included in non-LED applications of the light fixture 1200. In certain alternative exemplary embodiments, the light fixture 1200 includes one or more core members 605 with alignments that may or may not correspond to the typical position of a metal halide or high pressure sodium lamp that traditionally would be included in non-LED applications of the light fixture 1200.

An elongated structure 620 secures the core member 605 within the light fixture 1200, with a first end 620*a* of the elongated structure 620 being integral to or coupled to the member 605, and a second end 620*b* of the elongated structure 620 being integral to or coupled to a bracket 635 that is mounted within a housing 1205 of the light fixture 1200. Heat pipes 610 extend through at least a portion of the core member 605 and into the housing 1205. One or more fins (not shown) or active cooling modules 615 can be integral or coupled to an end 610*a* of each heat pipe 610, within the housing 1205, substantially as described above.

Figure 13:
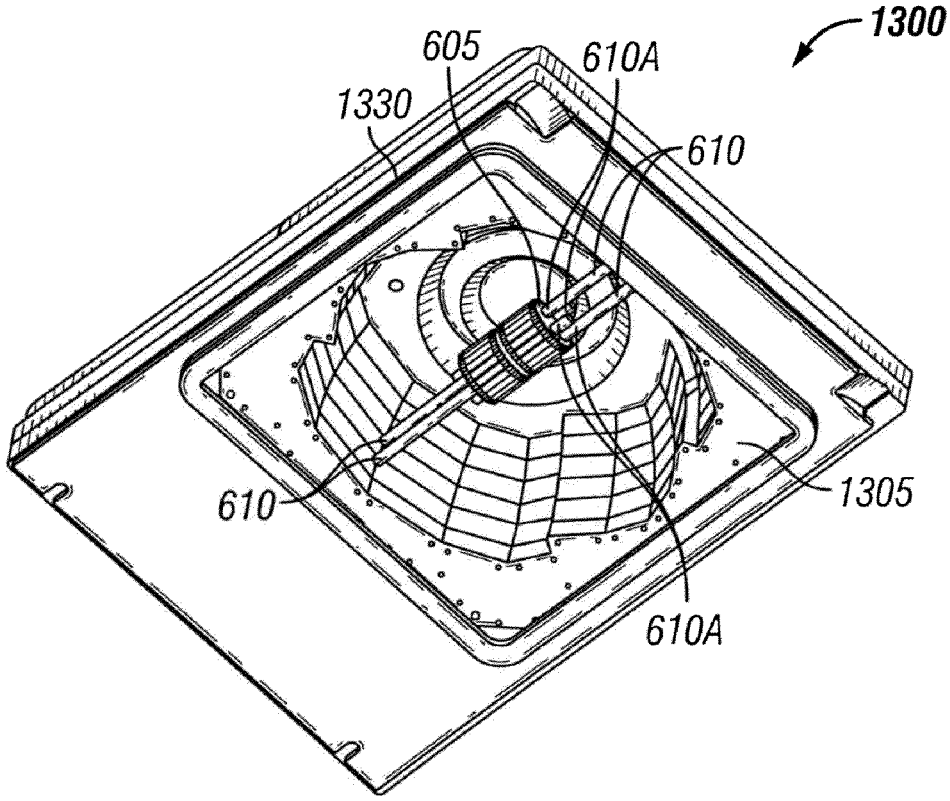
FIG. 13 is a perspective bottom view of still another light fixture that includes the core member of FIG. 8, according to yet other alternative exemplary embodiments.
Figure 14:
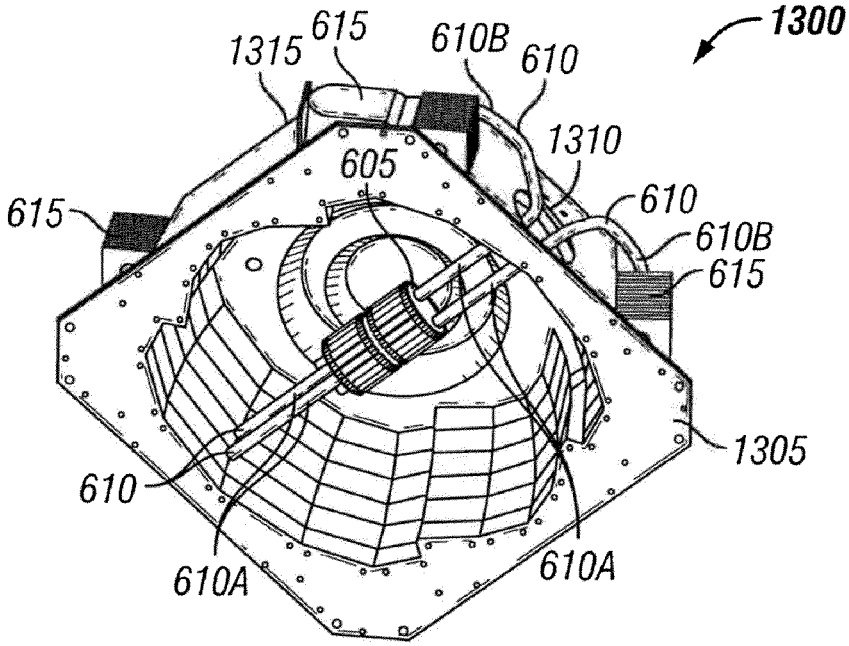
FIG. 14 is a perspective bottom view of the light fixture of FIG. 13 with certain components removed for clarity.

FIG. 13 illustrates an exemplary "talon" street light fixture 1300, which includes the core member 605. FIG. 14 illustrates the talon street light fixture 1300 with certain components removed for clarity. The talon street light fixture 1300 typically includes a single core member 605 extending substantially along a longitudinal axis of the light fixture 1300. In one exemplary embodiment, the alignment of the core member 605 within the light fixture 1300 substantially corresponds to a typical position of a lamp that traditionally would be included in non-LED applications of the light fixture 1300, such as a metal halide lamp or a high pressure sodium lamp. In certain alternative exemplary embodiments, the light fixture 1300 includes one or more core members 605 with alignments that may or may not correspond to the typical position of a lamp that traditionally would be included in non-LED applications of the light fixture 1300.

Heat pipes 610 secure the core member 605 within an interior region 1305*a* of a reflector housing 1305 of the light fixture 1300. Although illustrated in FIG. 13 without any separate elongated structure or other means for securing the core member 605 within the reflector housing 1305, one or more such structures may be provided in alternative exemplary embodiments of the light fixture 1300. A first end 610*a* of each heat pipe 610 is integral to or coupled to the member 605. A second end 610*b* of each heat pipe 610 extends through an aperture 1310 in the reflector housing 1305 and is coupled to an exterior surface 1315 of the reflector housing 1305. For example, the second end 610*b* of each heat pipe 610 can be integral to or coupled to a bracket (not shown) that is mounted to the exterior surface 1315. Alternatively, the second end 610*b* of each heat pipe 610 can be integral to or coupled to an active cooling module 615 that is mounted to the exterior surface 1315.

The reflector housing 1305 is disposed within another housing 1330. The reflector housing 1305 and all components coupled thereto, including the core member 605, the heat pipes 610, and the active cooling modules 615, are rotatable relative to the housing 1330. In one exemplary embodiment, the reflector housing 1305 and coupled components are capable of rotating in ninety (90) degree increments, allowing for manipulation of the optical distribution of the light fixture 1300. For example, the reflector housing 1305 and components can be rotated by (a) removing or releasing one or more screws (not shown) or other fastening devices securing the reflector housing 1305 within the housing 1330, (b) removing at least a portion of the reflector housing 1305 from the housing 1330, (c) rotating the reflector housing 1305 relative to the housing 1330, (d) aligning the rotated reflector housing 1305 with the housing 1330, and (e) re-securing the reflector housing 1305 to the housing 1330 via the removed or released screws or other fastening devices.

Figure 15:
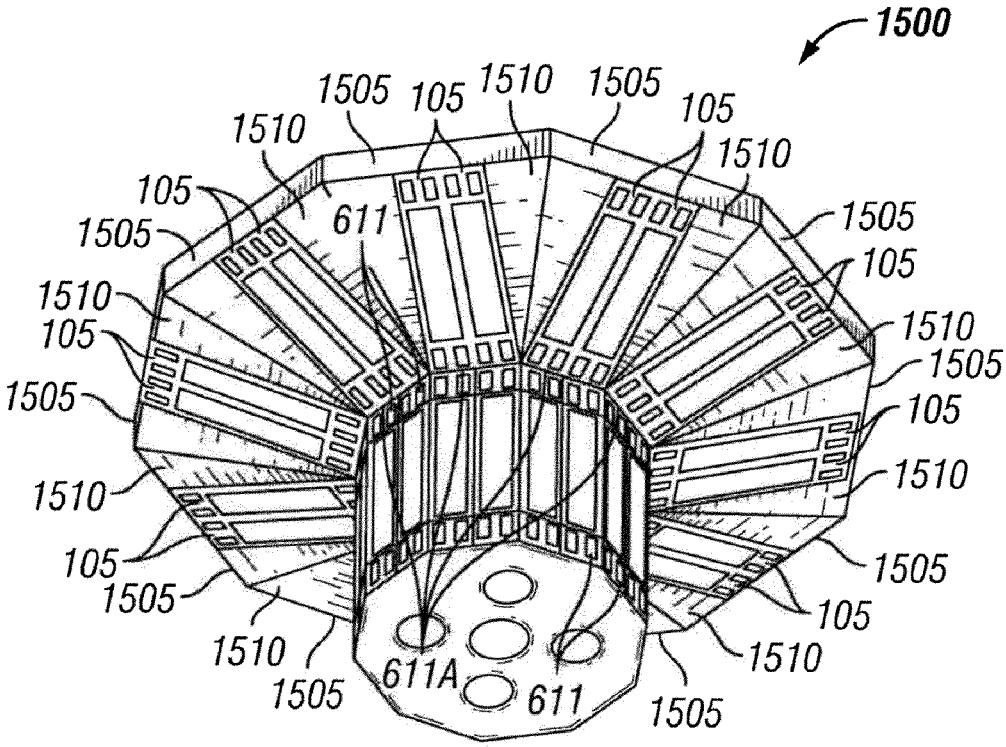
FIG. 15 is a perspective view of yet another light fixture that includes the core member of FIG. 8, according to still other alternative exemplary embodiments.

FIG. 15 is a perspective side view of a core member 1500, according to certain alternative exemplary embodiments. The core member 1500 is similar to the core member 605 except that the core member 1500 includes members 1505 extending angularly from a top end 611*a* of each facet 611. Each member 1505 includes a surface or "facet" 1510 on which at least one column of LEDs 105 is removably coupled. The LEDs 105 on the facets 1510 and 611 generate light for illuminating a surrounding environment, substantially as described above.

Figure 16:
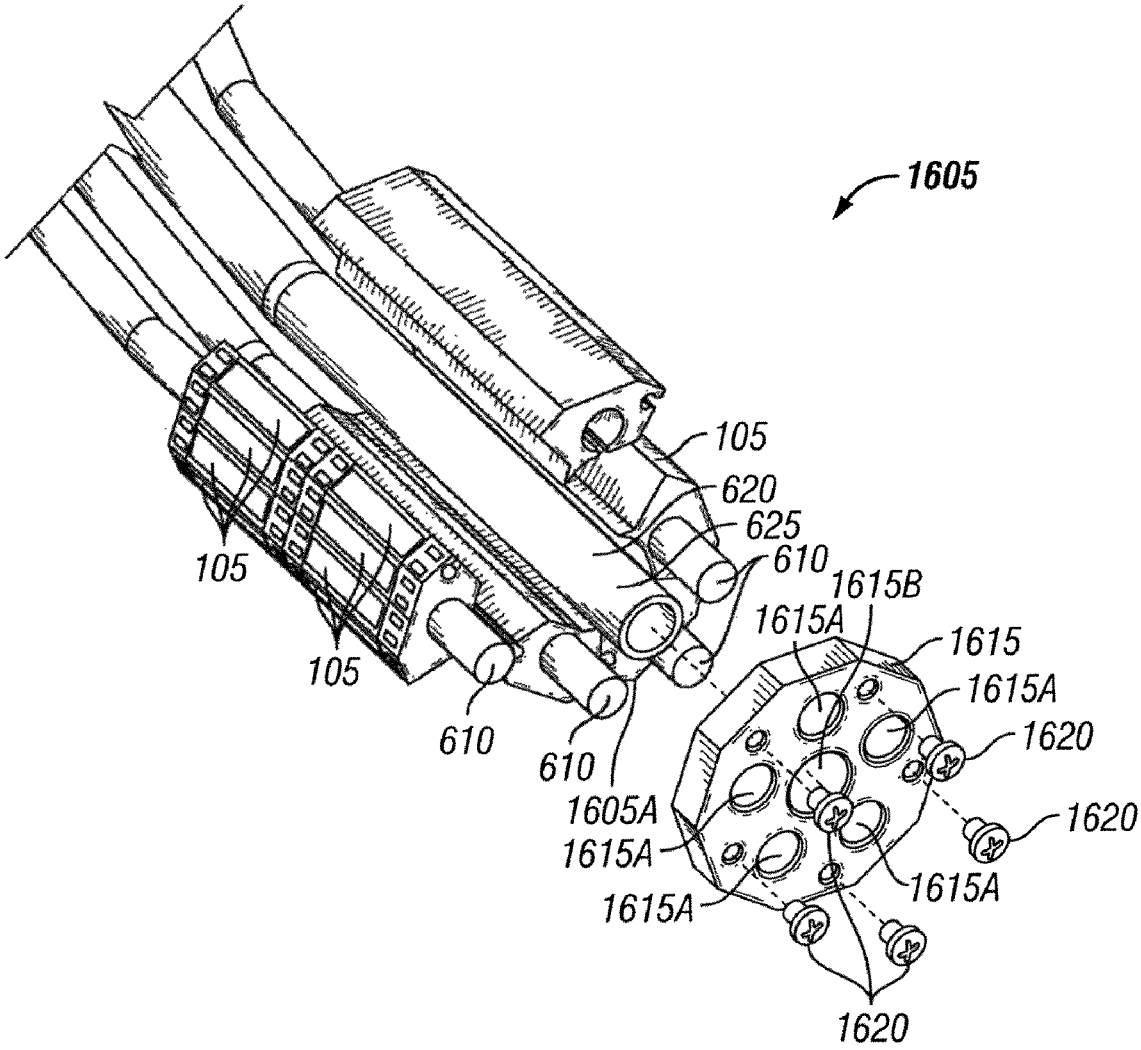
FIG. 16 is a perspective side view of a modular core member, elongated structure, and heat pipes, according to certain alternative exemplary embodiments.

FIG. 16 is a perspective side view of a core member 1605, elongated structure 620, and heat pipes 610, in accordance with certain exemplary embodiments. The core member 1605 is substantially similar to the core member 605 described above in connection with FIGS. 6-15, except that the core member 1605 has a modular design. Specifically, the core member 1605 includes multiple modules 1610 spaced around the elongated structure 620.

Each module 1610 includes an elongated body having an interior profile that substantially corresponds to an outer profile of at least a portion of the elongated structure 620. An outer surface of each module 1610 includes at least one facet 611. Although each of the modules 1610 depicted in FIG. 16 includes three facets 611, a person of ordinary skill in the art having the benefit of the present disclosure will recognize that each module 1610 can include any number of facets 611 in certain alternative exemplary embodiments. As described above, each facet 611 is operable to receive at least one column of LEDs 105. At least one heat pipe 610 extends through at least a portion of, and dissipates heat from, each module 1610. In certain alternative exemplary embodiments, there may not be any heat pipes 610 extending through at least some of the modules 1610.

The modules 1610 are connected together via a cover 1615 and one or more threaded nuts, screws 1620, nails, snaps, clips, pins, adhesives, or other fastening devices or materials. The cover 1615 has an interior profile that substantially corresponds to an outer profile of a top end 1605*a* of the member 1605. The cover 1615 is disposed over and around at least a portion of the top end 1605*a*. Apertures 1615*a* and 1615*b* in the cover 1615 receive ends of the heat pipes 610 and elongated structure 620, respectively.

If a module 1610 or an LED 105 or heat pipe 610 associated therewith breaks or otherwise requires service, the module 1610 may easily be replaced by exchanging the module 1610 with a different, working module 1610. Replacement of one module 1610 does not substantially impact operation of the other modules 1610. Therefore, service times and costs associated with a modular member 1610 may be less than that of a solid member, such as the core member 605 described above in connection with FIGS. 6-15.

Figure 17:
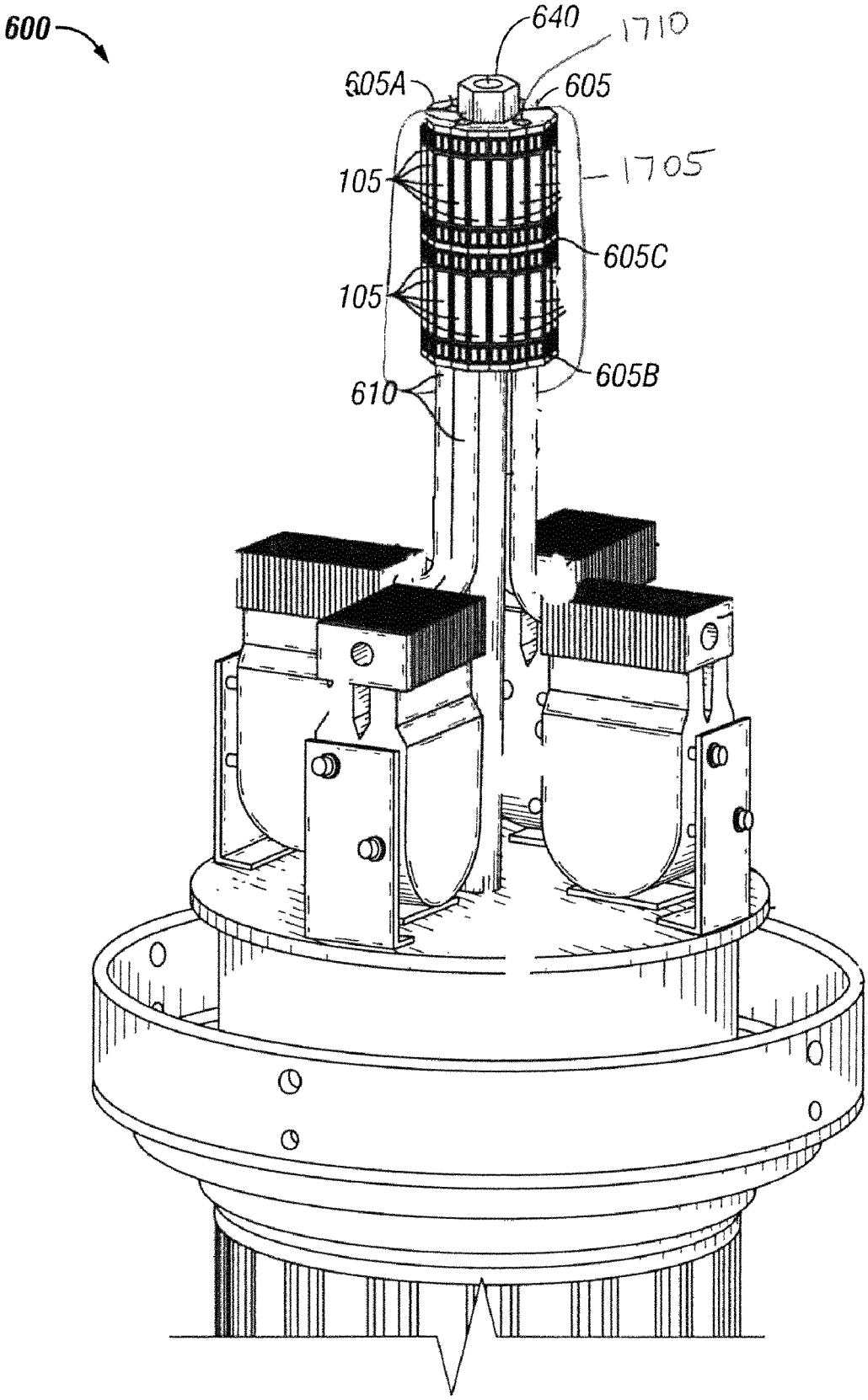
FIGS. 17 and 17A are perspective views of a light fixture having core member and an optional light transmitting enclosure, according to yet another alternate embodiment of the present invention.
Figure 17A:
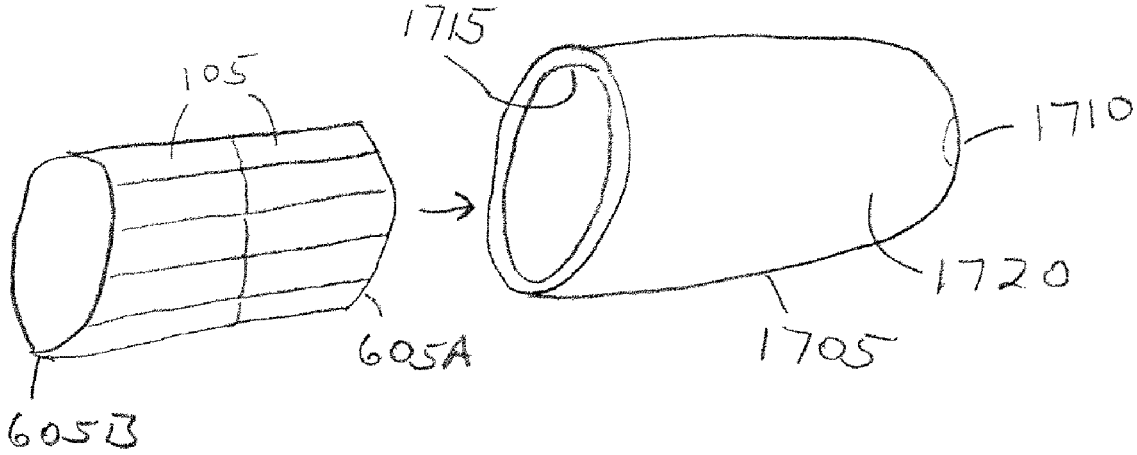

FIGS. 17 and 17A are perspective views of the light fixture of FIGS. 6 and 7 having a core member 605 and an optional light transmitting enclosure 1705, according to certain alternative exemplary embodiments. While the enclosure 1705 will be shown and described with reference to the light fixture 600 of FIGS. 6 and 7, the enclosure is also positionable about the portion of the core member 605 that includes the LEDs 105 for the fixtures shown and described in FIGS. 9-16 and also positionable about the outer surface 111 of the housing 110 of the fixtures shown in FIGS. 1-5.

Referring now to FIGS. 17 and 17A, the fixture 600 includes an enclosure 1705 that surrounds and substantially encloses at least the portion of the core member 605 that includes the LEDs 105. For example, as shown in FIG. 17, the enclosure 1705 can include an aperture 1710 for receiving therethrough a portion of a threaded rod (not shown) and being releasably coupled to the core member 505 along the top end 605A via one or more threaded nuts 640 screws, nails, snaps, clips, pins, adhesives, or other fastening devices or materials. In an alternative exemplary embodiment not shown, the enclosure can extend well beyond the length of the core member 605 and enclose a portion of the heat pipe 610. By enclosing the LEDs 105 on the core member 605 within the enclosure 1705, the wires and connectors for the LEDs are isolated to reduce the potential for an electrical short or the possibility of an electrical shock.

In certain exemplary embodiments, the enclosure 1705 can be constructed of glass, acrylic, polycarbonate or other materials known to those of ordinary skill in the art. In one exemplary embodiment, the enclosure 1705 is transparent. Alternatively, the enclosure 1705 is translucent. Further, in another alternative embodiment, the enclosure could include on the inner 1715 or outer 1720 surface thereof or embedded within additional optical structures. Examples of optical structures that are positionable on the inner 1715 or outer 1720 surface of the enclosure 1705 or embedded within the enclosure are prisms, blondels, micro optics. In another alternative embodiment, the inner 1715 and/or outer 1720 surface of the enclosure 1705 is textured to obscure the view of the LEDs 105 on the core member 605. In yet another alternative embodiment, the enclosure 1705 is coated with phosphors. In this example, the coated phosphor enclosure 1705 is typically used with LEDs that emit blue or ultraviolet light.

The use of a textured surface, optical structures, phosphor coatings, translucent materials or a combination thereof with the enclosure 1705 provides a more homogeneous luminous output emitted from the LEDs 105 on the core member 605 by providing a substantially uniform luminous output. Using any of these or a combination of these with the enclosure 1705 also improves the obscuration of the LEDs when viewed from the exterior of the lamp 600. This minimizes striations caused by the radical breaks in luminous continuity due to the multiple LEDs 105 on the core member 605. Using any of these or a combination of these with the enclosure 1705 also spreads the light emitted by the LEDs 105 over a greater area, decreasing the average luminance of light output by the LEDs 105 on the core member 605 and thereby improving visual comfort.

In an alternative to the enclosure 1705 shown and described in FIGS. 17 and 17A, an enclosure 610 of FIG. 6 is used with the core member 605. The enclosure 610 can be designed and implemented in the same or substantially similar manner as that of the enclosure 1705 except that the enclosure 605 is typically coupled to the base 615 and or to a cap 620 of the fixture 600 though know means including threading of the top and or bottom end of the enclosure 610 and the base 615 and/or cap 620 and the use of set screws, snaps, clips, pins, adhesives, or other fastening devices or materials known to those of ordinary skill in the art.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A light fixture, comprising:

a core member comprising:

a top end;

a bottom end;

a body extending between the top end and the bottom end; and a plurality of receiving surfaces spaced along an outer perimeter of the body, the receiving surfaces being operable to receive a plurality of light emitting diodes ("LED") packages in a plurality of different configurations, each configuration corresponding to a different optical distribution of the light fixture;

at least one LED package, each LED package comprising one or more LEDs and being coupled to a respective one of the receiving surfaces;

a heat sink positioned remotely away from the core member;

at least one heat pipe extending through at least a portion of the body of the core member and thermally coupled to the heat sink, the heat pipes being operable to dissipate heat generated by the LED package and transfer at least a portion of the heat to the heat sink;

a mounting component; and an elongated structure extending through at least a portion of the body of the core member, the elongated structure securing the core member to the mounting component, wherein the elongated structure is different from the heat pipes.

2. The light fixture of claim 1, wherein at least a portion of each heat pipe is surrounded by an inside surface of the body of the core member.

3. The light fixture of claim 1, wherein at least a portion of an outside perimeter of each heat pipe is in thermal communication with an inside surface of the body of the core member.

4. The light fixture of claim 1, further comprising at least one active cooling module, each active cooling module being coupled to, and being operable to cool at least a portion of, at least one of the heat pipes.

5. The light fixture of claim 1, wherein the mounting component comprises a reflector housing.

6. The light fixture of claim 1, further comprising at least one wire, each wire being electrically coupled to at least one of the LED packages, wherein the elongated structure comprises a tubular member that provides a passageway for at least a portion of each wire.

7. The light fixture of claim 1, wherein at least one of the LEDs is mounted directly on its respective receiving surface without a substrate being disposed between the LED and the receiving surface.

8. The light fixture of claim 1, further comprising a light transmitting enclosure disposed about the LED packages and disposed about at least a portion of the core member, wherein light emitted by the LEDs on the LED package passes through the enclosure to a surrounding environment.

9. The light fixture of claim 8, wherein the enclosure comprises an optical structure, the optical structure altering the light emitted by the LEDs.

10. The light fixture of claim 9, wherein the optical structure is selected from a group consisting of prisms, blondels, surface texturing, and micro optics.

11. The light fixture of claim 8, wherein the enclosure comprises a phosphor coating.

12. The light fixture of claim 8, wherein the enclosure obscures a view of the LEDs along the core member from the surrounding environment.

13. A light fixture, comprising:

a core member comprising:

a plurality of modules that collectively define a top end of the core member and a bottom end of the core member, each module comprising:

a body extending between the top end and the bottom end; and at least one receiving surface spaced along an outer perimeter of the body;

at least one LED, each LED being coupled to a respective one of the receiving surfaces;

a heat sink positioned remotely away from the core member;

at least one heat pipe extending through at least a portion of the body of the core member and thermally coupled to the heat sink;

a mounting component; and an elongated structure extending between the modules and securing the core member to the mounting component, wherein the elongated structure is different from the heat pipes, and wherein the receiving surfaces of the modules are operable to receive a plurality of light emitting diodes ("LEDs") in a plurality of different configurations, each configuration corresponding to a different optical distribution of the light fixture.

14. The light fixture of claim 13, wherein each heat pipe extends into a channel defined by at least a portion of the body of a corresponding one of the modules and being operable to dissipate heat generated by each of the LEDs coupled to the corresponding module.

15. The light fixture of claim 14, wherein the portion of each heat pipe that extends into the channel is entirely circumferentially bounded by the body of the corresponding module.

16. The light fixture of claim 14, wherein at least a portion of an outside perimeter of each heat pipe contacts an inside surface of the body of the corresponding module.

17. The light fixture of claim 14, further comprising at least one active cooling module, each active cooling module being coupled to, and being operable to cool at least a portion of, at least one of the heat pipes.

18. The light fixture of claim 13, wherein the mounting component comprises a reflector housing.

19. The light fixture of claim 13, wherein each module defines at least a first channel configured to receive at least a portion of a heat pipe; and a second channel configured to contact at least a portion of the elongated structure that secures the core member to the mounting component.

20. The light fixture of claim 13, further comprising at least one wire, each wire being electrically coupled to at least one of the LEDs, wherein the elongated structure comprises a tubular member that provides a passage for at least a portion of each wire.

21. The light fixture of claim 13, wherein at least one of the LEDs is mounted directly on its respective receiving surface without a substrate being disposed between the LED and the receiving surface.

* * * * *